US005205783A

United States Patent [19]

Dieckert et al.

[11] Patent Number: 5,205,783

[45] Date of Patent: Apr. 27, 1993

[54] AIR FLOW CONTROL EQUIPMENT IN CHEMICAL LABORATORY BUILDINGS

[75] Inventors: Joseph C. Dieckert, Bryan; Swiki A. Anderson, College Station, both of Tex.

[73] Assignee: Accu*Aire Systems, Inc., Bryan, Tex.

[21] Appl. No.: 748,793

[22] Filed: Aug. 22, 1991

[51] Int. Cl.[5] ..... F24F 7/00

[52] U.S. Cl. ..... 454/238; 454/59; 454/61; 454/252

[58] Field of Search ..... 454/61, 59, 238, 252

[56] References Cited

U.S. PATENT DOCUMENTS

| | | | |
|---|---|---|---|
| 4,150,606 | 4/1979 | Nelson | 454/61 |
| 4,160,407 | 7/1979 | Duym | 98/115 R |
| 4,466,341 | 8/1984 | Grogan | 454/61 |
| 4,517,883 | 5/1985 | Levchenko et al. | 454/61 |
| 4,706,553 | 11/1987 | Sharp | 98/115.3 |
| 4,741,257 | 5/1988 | Wiggin et al. | 454/59 X |
| 4,934,256 | 6/1990 | Moss et al. | 454/61 |
| 5,090,303 | 2/1992 | Ahmed | 454/238 X |
| 5,095,811 | 3/1992 | Shutic et al. | 454/238 X |

FOREIGN PATENT DOCUMENTS 2076145A 5/1980 United Kingdom .

*Primary Examiner*—William E. Tapolcai

[57] ABSTRACT

In the air flow control system of a laboratory building module, pressurization of corridors and other residual areas can be maintained neutral in relation to the outdoors by balancing the entire intake or supply flow rate and the entire exhaust rate. The laboratory rooms have various forms of fume hoods whose face velocities at their sash openings is regulated variously, either in response to sash position transducers or in response to face velocity sensors. Fume hoods having two sashes provide two sash-position transducers whose composite output represents the sash opening. A fume hood that relies on sensing of face velocity for correlating its exhaust flow rate with its sash opening utilizes the composite output of multiple face velocity sensors. Exhaust flow rates of fume hoods are regulated so as to increase more rapidly for greater sash openings than for smaller sash openings.

39 Claims, 10 Drawing Sheets

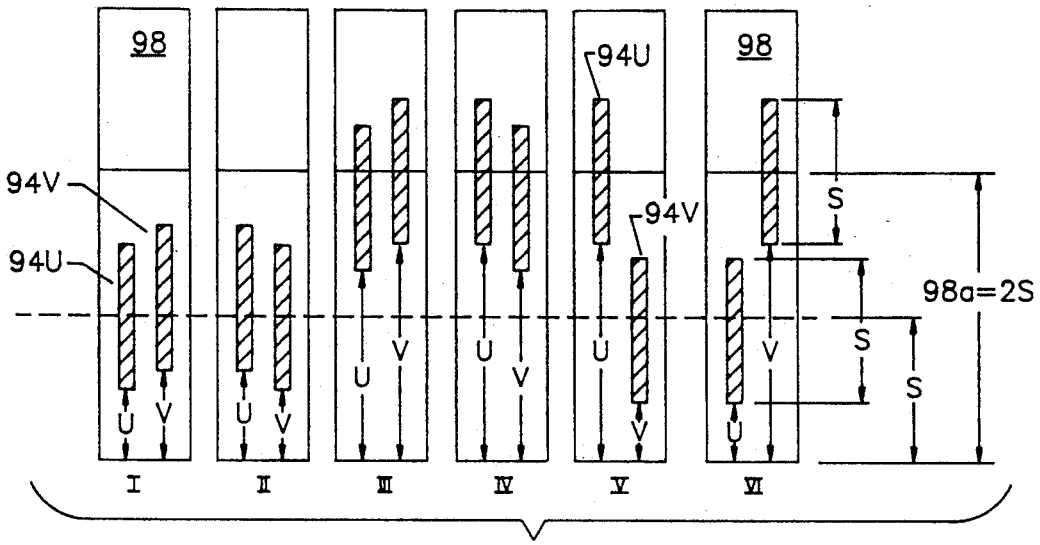
FIGURE 10A
FIGURE 10B
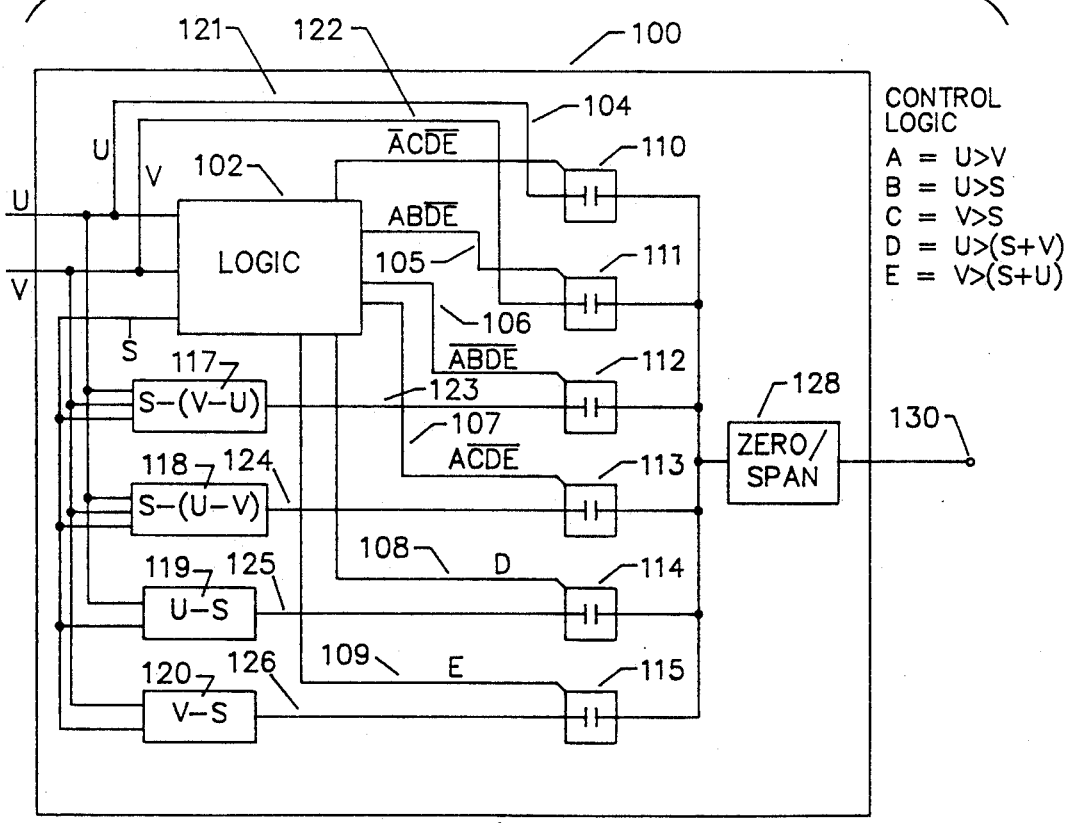

AIR FLOW CONTROL EQUIPMENT IN CHEMICAL LABORATORY BUILDINGS

The present invention relates to apparatus for controlling the flow of exhaust air from fume hoods in laboratory rooms and, more generally, for controlling the flow of air in buildings having laboratory rooms equipped with fume hoods or other rooms requiring precise and accurate air flow and temperature control.

BACKGROUND OF THE INVENTION

The ventilating system of a laboratory building (or of a laboratory subdivision of a building) is distinctive it contrasts with the ventilating system of a general purpose building. In the latter, it is customary to recirculate most of the air within a building, discharging a small percentage of it from the building and replacing that discharged with fresh air from outside the building. In contrast, the air taken into a laboratory building is comfort-conditioned and supplied both to non-laboratory areas and to laboratory rooms and the total volume of that comfort-conditioned air delivered to laboratory rooms is discharged from the building. Particularly because the comfort-conditioned air is not recirculated, any air that is needlessly discharged as exhaust from the fume hoods of laboratory rooms constitutes substantial waste. Air supplied to laboratory rooms is exhausted from the room through the fume hoods.

A fume hood is open at the front to provide access to the experimental equipment and material contained in the hood. A normally closed sash shuts the fume hood's access opening; the sash is opened adjustably as needed for access to the experimental set-up. Exhaust air, or "exhaust", is drawn from the room into the fume hood and then into an exhaust duct, for assurance against fumes entering the laboratory room. The exhaust flow of a single fume hood may be induced by a dedicated variable-capacity fan. However, among many fume hoods that discharge exhaust into a common duct, each fume hood has its own adjustable air valve or damper, commonly called a "variable air volume box" or "VAV box". The exhaust "volume" or volumetric flow rate is measured in cubic feet per minute, or "CFM", and exhaust flow is induced by a negative pressure gradient in the exhaust duct, with pressure becoming more negative in the direction of exhaust flow toward the fan.

A fume hood characteristically has some form of bypass passage for allowing a minimum flow of air through the fume hood while its sash is closed; the purpose of this is to continuously ventilate the cavity in the hood to avoid a build-up of a high concentration of fumes within the hood. Consequently, the VAV box is maintained open sufficiently to sustain a minimum flow of air into the hood through the bypass passage.

The volumetric flow rate of air into a hood should be great enough to develop a safe "capture velocity" at all points across the plane of the hood sash opening to ensure a sufficient velocity to assure entrainment of fumes into the hood and thus prevent escape of fumes into the laboratory room. The average velocity of air entering all the unit areas of the sash opening is called the "average face velocity". The average face velocity should be high enough to develop the required capture velocity as well as to insure sufficient face velocity at any local point in the plane of the hood at any hood sash opening.

For economical use of the air supplied to a laboratory room, the dedicated exhaust fan or the VAV box is adjusted in coordination with the sash opening. The two basic types of control mechanisms for achieving this goal are known. According to conventional wisdom, the volumetric rate of air flow into the hood sash opening should be varied linearly with changed sash openings for both types of control of the exhaust flow rate.

One form of exhaust flow control for a fume hood depends on an air velocity sensor in a passage from the space in front of the fume hood to the space inside the fume hood cavity, called a "face velocity sensor". Commonly, that sensor is an electronically heated sensor that is cooled variably as a function of the air velocity across it through the passage. The sensor is part of a control circuit designed to maintain constant air velocity past the sensor. As the sash opening changes, the control circuit adjusts the volume flow rate. This form of control over the volumetric flow rate of air through the fume hood is primarily used for fume hoods in which the sashes are encased in a panel with vertical movement of the encasement and with work panels that slide in the encasement horizontally (i.e.—"combination sash" hoods) or in hoods where the base panels can only slide horizontally in a track (i.e."horizontal sliding sash" hoods).

In another form of exhaust flow control for a fume hood, a sash position sensor is used to control the volumetric exhaust flow rate. For example, the sensor may be a potentiometer or a 3–15 psig control valve coupled by a cable to the sash or geared to turn with displacement of the hood sash. Commonly, this form of control is used for fume hoods in which a single sash panel is adjusted vertically.

The control of the volumetric flow rate of exhaust discharged by a fume hood or fume hoods of a laboratory room reflects on the supply of air into the laboratory room. This is so, in part, because a laboratory room is supplied with comfort-conditioned air from a supply duct at a rate controlled by a VAV box which, in turn, responds to a signal representing all of the laboratory room's exhaust flows. The flow rate from the supply duct into the laboratory room is normally controlled to be slightly less than (or in select instances greater than) the total exhaust flow rate, to establish either a slightly negative laboratory room pressure (for guarding against escape of fumes from the laboratory room) or a slightly positive pressure (for guarding against airborne particles entering a "clean room".) In the more common situation where infiltration into a room is desired, the difference between the controlled supply volume of air into a laboratory room and the larger total of all exhaust flows out of the laboratory room is made up by a supplemental flow of air into the laboratory room from a corridor or other non-laboratory area adjoining the laboratory room. The difference between the controlled room supply and exhaust is the infiltration air and it moves through constrictions such as the gap between a laboratory-room door and its sill, to sustain the laboratory room's negative pressure difference relative to the non-laboratory area.

The exhaust flow from a laboratory room may be only the exhausts of the fume hoods of that laboratory room. However, the laboratory room exhaust may include air that is drawn out of the laboratory room through an air valve that responds to a room thermostat. In this way, comfort-conditioned air can be supplied to the laboratory room even when the combined fume-hood exhaust flow is not sufficient during periods long enough to maintain the laboratory room at a comfort level.

Supply of air to the laboratory rooms and other rooms and non-laboratory areas entails certain recognized constraints, notably control of pressurization of the building. Efforts have been devoted to maintaining the air pressure inside a building neutral relative to the ambient atmospheric pressure (i.e. avoiding infiltration into the building or exfiltration from the building). If the pressure inside the building deviates significantly from the sustained pressure outside the building, comfort-conditioned air may be expelled, a costly waste; or external air that is not comfort-conditioned may be drawn into the building. Moreover, a seemingly small inside-to-outside pressure difference can develop a large and potentially destructive force acting on a large wall or window area. Static pressure sensors have been tried for maintaining neutral pressurization, but satisfactory low-cost, high-sensitivity sensors for such low pressure levels are, at least, very expensive and very difficult to find. Additionally, any such pressure sensor inside a building is vulnerable to the effects of winds at the windward and leeward sides of the building. Winds tend to cause spurious local pressure changes inside the building, affecting such highly sensitive static pressure sensors.

SUMMARY OF THE INVENTION

In devising the mechanisms, devices and circuits for controlling the exhaust flow of fume hoods, it has commonly been considered that the volumetric flow rate should be a linear function of the sash opening to maintain adequate minimum face velocity as the sash opening is changed for avoiding wasteful discharge of comfort-conditioned air. Pursuant to one of the aspects of the invention, adequate capture velocity of air entering a fume hood is realized more effectively by causing the volumetric flow rate through the fume hood to increase essentially in proportion to the sash opening (constant average face velocity) as the sash opening increases to its halfway open condition, and then to increase the flow rate more rapidly as the sash approaches its fully open condition (greater average face velocity). This variation of flow rates versus sash openings is herein called "controlled non-linearity." In contrast, using linear control for the full range of sash openings results in an excessive and wasteful flow rate for a portion of the range of sash positions, or the flow rate is insufficient for assured capture of fumes as the sash becomes wide open.

The principle of disproportionately increasing the flow rate of a fume hood versus its sash opening is particularly effective for the kind of fume hood that has a vertically adjustable sash. It may be considered that the sash forms an orifice between the fume-hood cavity and the room that houses the hood, the pattern of air entering the fume-hood cavity varying as the sash opening grows larger. The pattern of turbulence induced by the sash at the hood opening and the resulting eddy currents developed at the hood sash opening and inside the fume hood varies as the sash opening increases. A transducer coupled to the sash provides an output signal to a control circuit that regulates the exhaust flow rate in the fume hood's exhaust passage and exhaust duct. In this aspect of the invention, the non-linear flow-rate variation may be caused in various ways, either in a VAV box and its actuating mechanism; or in the sash position transducer itself or in its coupling to the sash; or it may be incorporated in various ways in the control circuit that coordinates the flow-rate control device with the sash position. As will appear in the detailed description below, certain forms of the novel control circuit are distinctive and particularly effective.

A large "walk-in" form of fume hood is available, having two vertically adjustable panels which, together, form a composite adjustable sash. Pursuant to a related aspect of the invention, signals are provided by separate position transducers that are coupled to the panels that act, together, as an adjustable sash; and those signals are combined and used in a logic switching matrix for transmitting only a selected composite signal. That transmitted signal is used in controlling the fume hood's volumetric flow rate. Just as with a fume hood having a single vertically adjustable sash, the exhaust flow rate in a fume hood having a composite sash can be made to increase more than proportionately as the net sash opening increases.

The principle of disproportionately increasing the flow rate versus the sash opening is also applicable to the kind of fume hood that cannot—or does not—have a sash position sensor. In such fume hoods, a "face" velocity sensor in the fume hood provides an output signal which is used in a control circuit for increasing the exhaust flow rate of the fume hood more rapidly for the range of the sash openings above roughly the halfway open condition than for smaller sash openings. This provides assurance of an adequate face velocity as the size of the sash opening approaches its fully open position.

As a related aspect of the invention, the usual single air velocity sensor in such fume hoods for deriving a representation of face velocity is modified; instead, two air velocity sensors are placed at widely separated locations in the fume hood. A combined signal from two air velocity sensors yields a far more dependable representation of the face velocity in such a fume hood than that provided by only one air velocity sensor. Ordinarily one would assume that an air velocity sensor should serve (or it can be calibrated to serve) as an indicator of the face velocity of a fume hood. However, shifting patterns of air flow (i.e., eddy currents induced into the hood by the sash opening) inside a fume hood occur in practice. The use of multiple air velocity sensors at widely spaced positions, their output signals being combined and averaged, tends to nullify error due to random transitory changes of the eddy, or secondary flows. Use of even one additional air velocity sensor provides a considerable degree of immunity to the effects of transitory flow patterns. The improved result is further assured by locating two air velocity sensors in the hood wall, typically at opposite sides of a fume hood, positioned at different levels in the fume hood.

At times, all the air drawn into a laboratory room may leave via the fume hoods into the exhaust duct system. A laboratory room may also have a thermostat-controlled VAV box for discharge of air from the laboratory room. As noted above, the valve modulated supply of air to a laboratory room is supplemented by air entering (or leaving) the laboratory room from an adjoining corridor or other non-laboratory area, resulting from a negative or positive pressure in the laboratory room.

Other rooms may share the building's air supply, such as an office having a VAV box modulated by its room thermostat. Air leaving an office may enter a corridor or enter non-laboratory areas, becoming a part of the air that ultimately reaches the exhaust duct system of a laboratory building.

Regulation of the supply of comfort-conditioned air to laboratory rooms, office rooms, and at times other rooms, is subject to control in response to local conditions, i.e., conditions pertaining specifically to those rooms, respectively. The supply of air to some other areas a laboratory building is not subject to local-condition control. Such areas may be called "residual areas"; these include areas that provide "spill" air to (or from) adjoining laboratory rooms.

An entire laboratory building may be served in common by a single ventilating system having a single supply fan contained in an air handling unit, a single exhaust fan, supply and exhaust ducts, etc. A single ventilating system may be allocated to serve a laboratory subdivision of a building. The term "laboratory building module", and at times "laboratory module", are used below to refer both to an entire laboratory building and to a laboratory room subdivision of a building.

Pursuant to a further aspect of the invention, the entire intake volumetric flow rate of a laboratory building module is regulated so as to remain in balance with its entire exhaust volumetric air flow, in this way to develop neutral pressurization of the laboratory building module. In unusual situations, the neutral pressurization of a laboratory building module is achieved by regulation of the volumetric rate drawn from the residual areas into the exhaust duct, as may be required in dependence on various factors. Laboratory rooms may be negatively pressurized and, accordingly, a flow of air enters or infiltrates into laboratory rooms from the adjoining residual areas. Negative pressurization control is used for such areas as wet chemistry laboratory modules. Air exfiltrates from positively pressurized rooms such as clean rooms, operating rooms, etc. The exfiltrate enters the exhaust duct system if it is contaminated; otherwise exfiltrate from positively pressurized rooms enters the adjoining residual areas. In addition, flows of air are supplied to offices and other thermostat-regulated rooms that do not have fume hoods and are not pressurized. Flows leaving such rooms are commonly received by their adjoining residual areas.

Neutral pressurization of the laboratory module's residual areas can be accomplished effectively by controlling the net volumetric flow rate from the laboratory module's supply duct into its residual areas or (in rare situations) by controlling the net volumetric flow rate from the residual areas into its exhaust duct, so as to balance and make up the difference in flow between the laboratory module's forced supply volumetric flow rate and its exhaust volumetric flow rate.

Positive static pressure is maintained at the entry side of the supply system's air valves to enable the valves to act as flow-regulators; i.e. always sufficient static pressure to allow the supply valves to throttle the flow. The valves provide resistance to air flow, so that there is a pressure drop between the entry and exit sides of the air valves. In a further aspect of the invention, the capacity of a laboratory module's supply or intake fan is made variable to maintain a positive pressure in the supply duct system at one or more control points at the inlet sides of such supply system air valves. It might be considered that varying the fan speed would upset the relationships among the flow rates described above. However, when the static air pressure at the inlet side of a VAV box is constant, its flow rate will correspond to its set point adjustment. Moreover, the actual flow through a VAV box can be maintained at a desired rate by incorporating a flow sensor and a feed-back loop responsive to the flow sensor in the control circuit of each VAV box which makes the control function of the VAV box duct system static pressure independent.

Negative static pressure is maintained at the discharge or exhaust-duct-system side of the exhaust system's air valves to enable those valves to act as flow-regulators. In an aspect of the invention related to maintenance of negative pressure in the supply duct system, the capacity of the exhaust system fan is made variable to maintain a negative system static pressure at one or more points in the exhaust duct system at the discharge sides of the exhaust air valves. The purposes and qualifications of the exhaust valves correspond to the foregoing comments concerning the system's supply valves. Maintenance of an appropriate static pressure at a point or points in the exhaust duct system tends to sustain flow rates of the exhaust valves that are in accordance with the set point adjustments of the exhaust valves.

The invention in its various aspects will be better understood in the light of the following detailed description of illustrative embodiments of those various aspects of the invention and from the accompanying drawings.

BRIEF DESCRIPTION OF THE DRAWINGS

FIG. 10A is a six-part diagram of various positions of the two sash panels of FIG. 10;

FIG. 10B is a block diagram of a novel circuit and a related logic table for providing a sash opening signal for the two-panel sash of FIG. 10;

DETAILED DESCRIPTIONS

Figure 1:
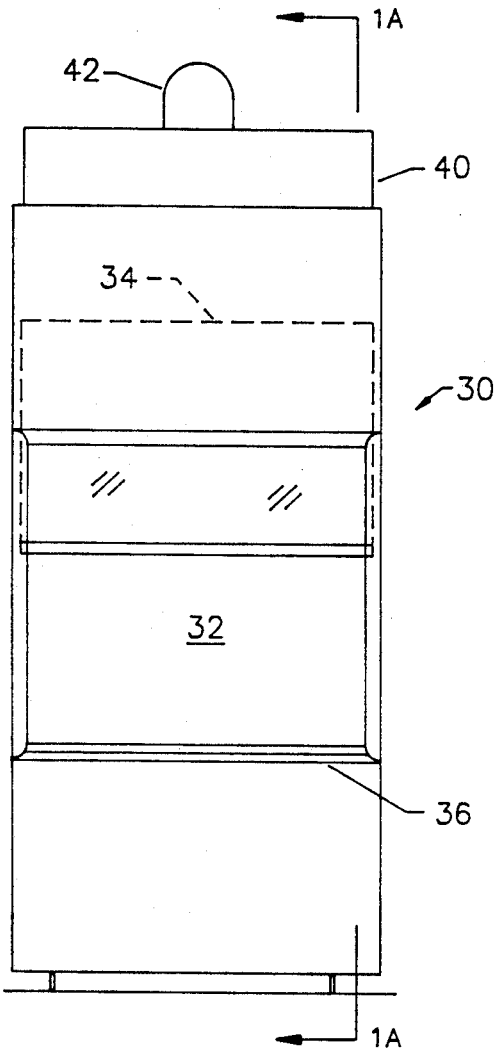
FIG. 1 is a front elevation of a typical fume hood having a vertically adjustable sash.
Figure 1A:
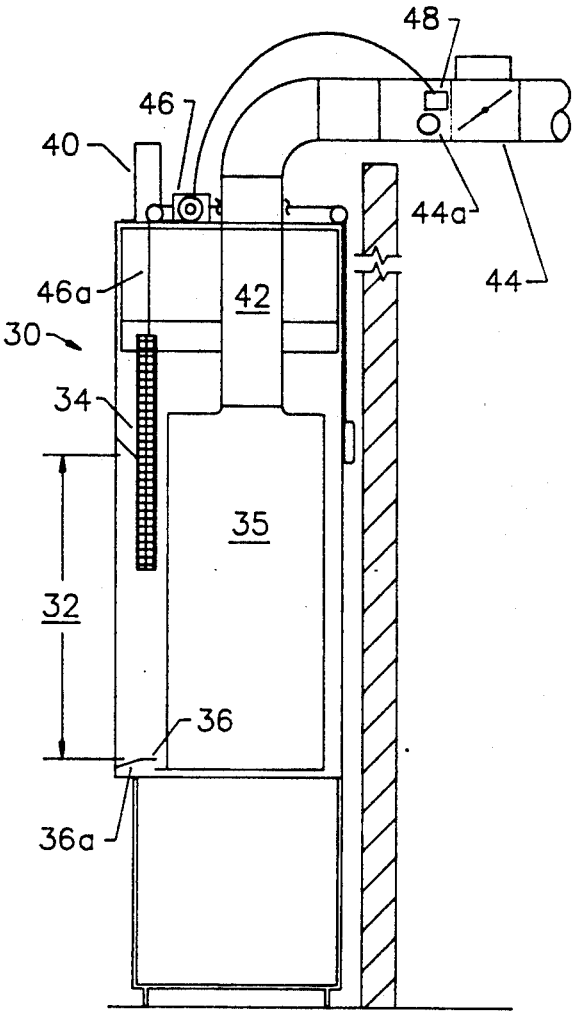
FIG. 1A is lateral cross-section of the fume hood of FIG. 1, generally at the plane 1A—1A in FIG. 1.

FIGS. 1 and 1A illustrate a well-known fume hood of the type having a vertically movable sash. The fume hood 30 comprises basically a six-walled enclosure whose front wall provides a sash opening 32. Sash 34 of the hood is adjustable between its shut and fully open positions. A five-walled chamber 35 within the enclosure is to contain experimental apparatus and material. The open front of chamber 35 provides access to its contents, to the degree that the sash is open. When shut, sash 34 engages a foil 36 that extends across the bottom of opening 32 of the fume hood. Foil 36 provides a passage 36*a*, being a bypass passage to admit airflow into the enclosure even when the sash is shut. The bypass passage may take many different forms; its purpose is to allow an opening for continuous hood exhaust thus avoiding accumulation of a high concentration of fumes in the hood when the sash is shut. A sash cap 40 receives and encloses a portion of the sash when in its fully open position; its purpose is to seal and thus eliminate the flow of air through this secondary airflow path. Thus, the only opening into the fume hood cavity from the room should be through the hood sash and foiled opening below the sash; all other paths should be sealed.

An exhaust system, described below, draws air into opening 32 and bypass passage 36*a*. The fume hood's exhaust duct 42 is part of an exhaust duct system. Comfort-conditioned air, upon entering the fume hood, becomes exhaust air (also called "exhaust") as it enters the exhaust system. A damper or air valve normally a part of a system static pressure independent VAV box 44 determines the flow rate of air through the VAV box and thus from the fume hood. "VAV" signifies "variable air volume", referring to a flow rate that is expressed in cubic feet per minute or CFM. The damper in the box responds to the flow through the box, independent of differential pressure across the box (thus the term "system static pressure independent.) Damper 44 is virtually the sole control over the rate of flow of air through the fume hood; that flow rate is virtually unaffected by the sash in its various positions. In some situations, notably where the fume hood is not part of a multiple-hood installation, a variable-speed blower or a fan with adjustable-pitch blades or throttling dampers can be used to control the flow rate, replacing the damper in the VAV box.

A sash sensor provides a sash position-representing output signal. Commonly, that sensor is a transducer, typically a potentiometer 46. Control circuit 48 responds to the sash position signals by variably energizing an electric-to-pneumatic adjustment mechanism 44*a*. In this form of fume hood, damper 44 is always at least partway open, for sustaining the flow of air into the hood cavity through the bypass passage 36*a* when the path through the sash opening is closed.

Ordinarily the fume hood sash remains closed. When access to the interior of the fume hood is required, the sash is opened. The exhaust flow rate is adjusted under control of the sash position transducer 46 for sustaining at least a sufficient velocity of air entering the sash opening to prevent fumes from escaping into the space in front of the fume hood, i.e., "the user breathing zone". The total flow rate of the air entering the sash opening divided by the area of the sash opening is an arithmetic average of the air velocities of all the unit areas of the sash opening. The velocity is different at different unit areas in the plane of the sash opening. The average velocity of the air entering the unit areas of the sash opening is called the "average face velocity" and the different velocities in the unit areas are "local face velocities". Values of face velocity that are considered safe vary with the degree of harm that could result in case fumes were to escape. For example, for fumes of high toxicity, recommended values of average face velocity range from 125 to 150 FPM; and minimum recommended values of local face velocity for any unit area range from 100 to 125 FPM.

Patterns of air turbulence and eddy currents in a fume hood and at the fume hood sash opening develop; the patterns vary due to many factors. They may shift as a person walks near a fume hood and passed an open sash; and various random occurrences in a laboratory room affect the pattern of velocities of the air entering a sash opening. Eddy currents or "secondary flows" also occur because a flow induced momentum gradient always exists between the solid boundaries of a hood and the free stream region of flow into the center of the hood sash opening. Taking such effects into consideration, a volumetric flow rate of a fume hood in CFM is adopted such that the average face velocity in FPM is safely above the minimum capture local velocity under ordinary circumstances. In installations where the volumetric flow rate is adjusted in relation to sash openings to conserve conditioned air, the flow rate is commonly made proportional to the sash opening in usual practice.

Figure 2:
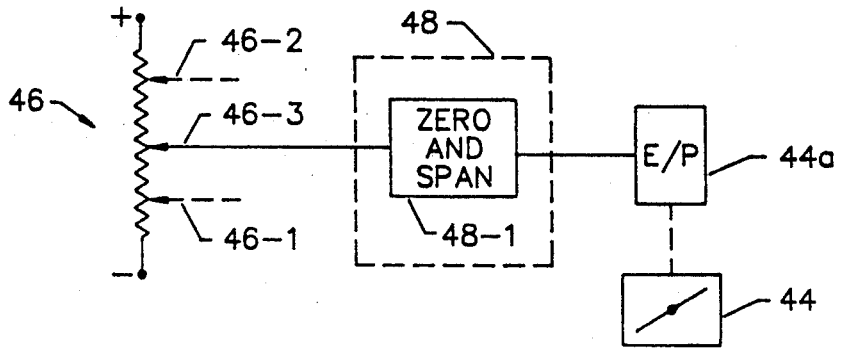
FIG. 2 is a block diagram of an open-loop exhaust flow control circuit for the fume hood of FIGS. 1 and 1A.
Figure 2A:
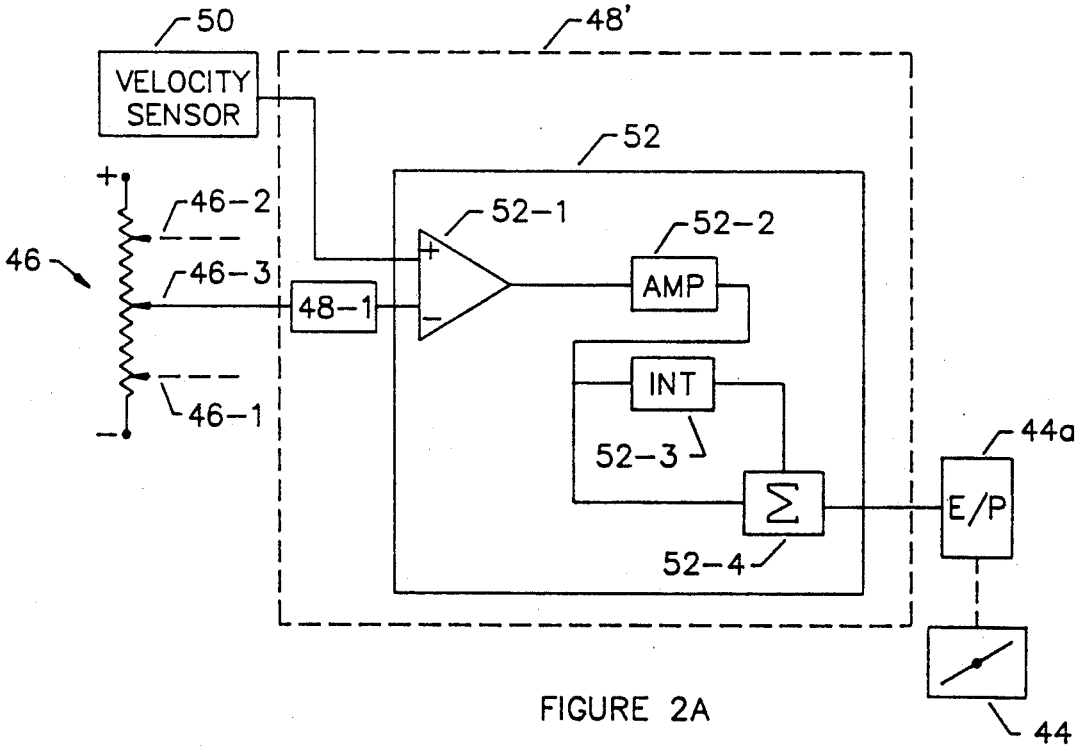
FIG. 2A is a block diagram of a control circuit like FIG. 2, FIG. 2A having a feedback loop.

Control circuit 48 may act according to two general principles to control damper 44, either open-loop control or closed-loop control as represented in FIGS. 2 and 2A, respectively. The same reference numerals are used in these Figures and in FIGS. 1 and 1A to designate the same components.

In FIGS. 2 and 2A, potentiometer 46 has an adjustable contact coupled to the sash and a d-c supply connected to its terminals. Broken-line arrows 46-1 and 46-2 represent the positions of the adjustable contact when the sash is closed and when it is fully open, respectively. The output signal depends on the random position of a slide contact 46-3 (the solid line) of the potentiometer. A well-known "zero and span" circuit 48-1 in control circuits 48 and 48' converts the input from transducer 46 to output varying from zero to a maximum when the slide contact of the potentiometer moves through the range 46-1 to 46-2. The output signal of circuit 48 causes the voltage-to-pneumatic converter 44*a* (E-to-P) to operate air valve 44. The valve and its voltage-controlled pneumatic actuator and the linkage between the valve and its actuator form a commercially available unit; that unit is designed to provide a flow rate which is proportional to the applied signal. However, the linkage between unit 44*a* and valve 44 may have an adjustment such that a desired flow rate for bypass path 36*a* (FIG. 1A) is sustained at zero volts input to unit 44*a*; or control circuit 48 may provide for the bypass air flow when the sash is shut.

FIG. 2A differs from FIG. 2 in that a feedback loop is included in FIG. 2A. Exhaust duct 42 of FIG. is equipped with an exhaust flow-rate sensor 50 (FIGS. 2A and 3) for providing a flow rate representing signal. Component 50 is described in detail below.

In FIG. 2A, activating circuit 52 for the E-to-P actuator 44*a* responds to the flow-rate signal from sensor 50 and the sash position signal from circuit 48-1. Those signals are applied to the (+) and (−) inputs of comparator 52-1. Unbalanced output of comparator 52-1 is applied to both integrator 52-3 and summer 52-4; and the output of integrator 52-3 is also an input to summer 52-4. A shift of the sash and its transducer causes unbalance between the inputs to comparator 52-1. The integrator responds slowly; the direct comparator-to-summer channel causes relatively rapid readjustment of the damper, so as to change the flow rate. The output of sensor 50 is changed accordingly; and those changes are gradually accumulated in integrator 52-3. At equilibrium, a voltage is stored in integrator 52-3 that maintains the flow rate at a fixed value corresponding to the setting of the sash position transducer.

Figure 3:
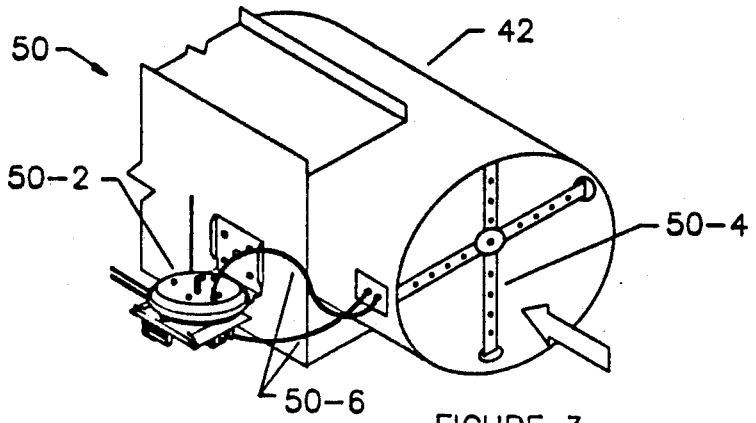
FIG. 3 is a perspective view of flow-rate sensing apparatus useful generally and in the circuit of FIG. 2A.
Figure 3A:
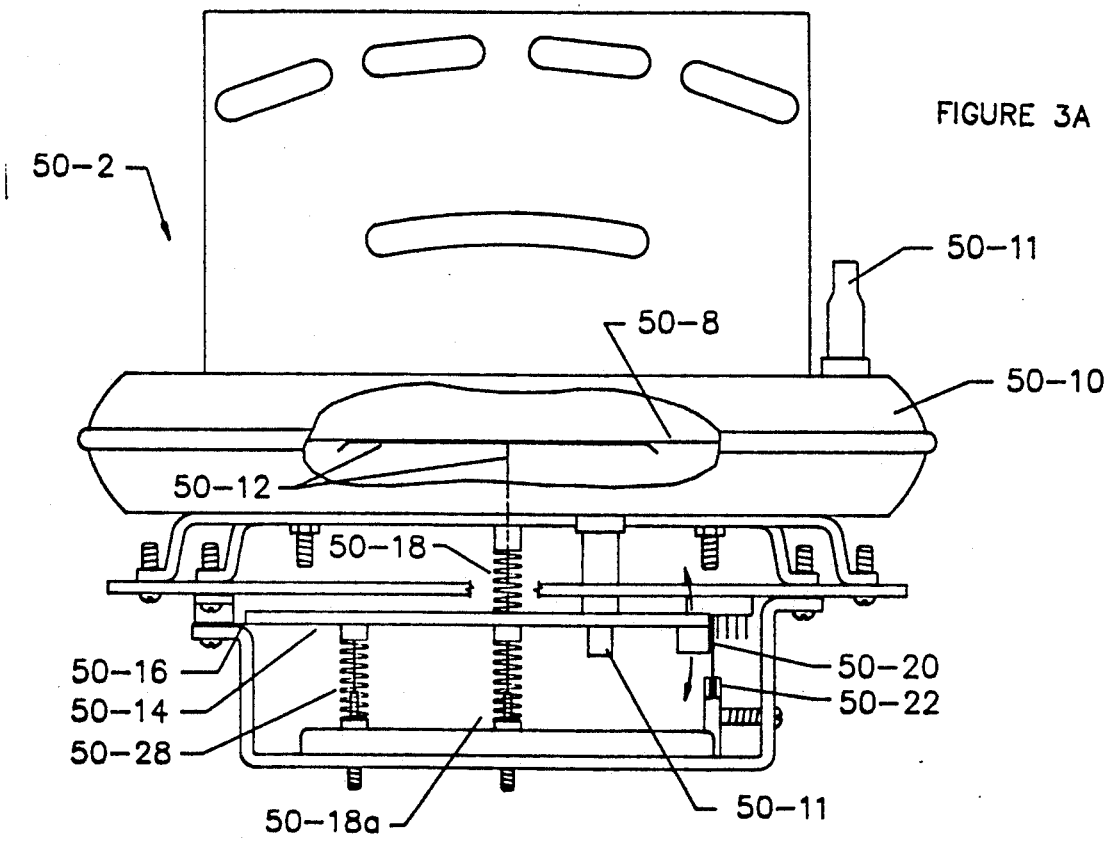
FIG. 3A is a side view of a component in FIG. 3, drawn to larger scale, portions being broken away, being a known device modified for present purposes.
Figure 3B:
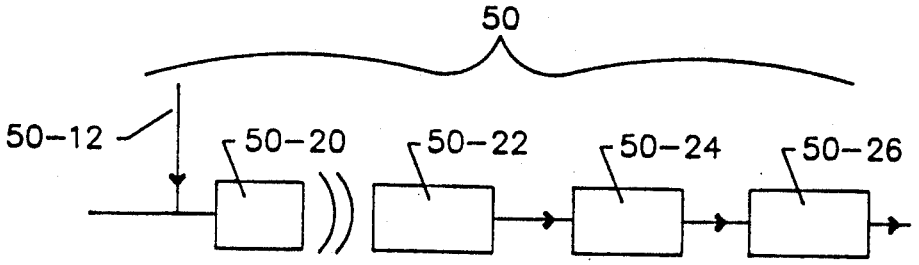
FIG. 3B is a block diagram of a known circuit for providing a linear output signal representing the operation of the apparatus in FIG. 3.

FIG. 3 represents an exemplary flow sensor 50; FIG. 3A shows a component 50-2 of sensor 50 drawn to larger scale; and FIG. 3B is a block diagram of circuit equipment that converts the mechanical output of component 50-2 to a flow-rate representing signal.

In FIG. 3, a "flow cross" 50-4 is shown, fixed in exhaust duct 42 (see FIGS. 1 and 1A). Each of the four arms of the flow cross represents paired front and rear chambers. There are holes all along the surface of the front chamber that faces the flow (indicated by the arrow). Positive pressure develops in the front chamber of each arm. A flow induced negative pressure develops in the rear chamber. The differential pressure is transmitted via paired tubes 50-6 to opposite sides of a rubber membrane 50-8. This membrane divides the cavity of metal enclosure 50-10 into two chambers. Fittings 50-11 connect tubes 50-6 to those chambers. Downward pressure of the diaphragm is exerted on bar 50-14 via plate-and-rod unit 50-12. A leaf-spring hinge 50-16 connects bar 50-14 to the frame of unit 50-2. The pressure from the diaphragm on bar 50-14 is balanced between coil spring 50-18 and spring 50-18*a*. These springs act oppositely on the bar; they have a linear force-deflection characteristic. Thus, the described flow-cross 50-4 and unit 50-2 respond to the flow in duct 42 so as to deflect bar 50-14 in proportion to the differential pressure in the flow cross.

A permanent magnet 50-20 is carried by bar 50-14 at its free end. A Hall-effect solid-state device 50-22, adjustably mounted, produces an electrical output signal that varies linearly with the deflection of magnet 50-20. The Hall-effect device is a commercially available component. In FIG. 3B, the diaphragm-actuated element 50-12 causes magnet 50-20 to be deflected, activating the Hall-effect device The output of device 50-22 is made to be zero when there is no air flow in duct 42, as by adjusting the position of device 50-22 or by providing suitable electrical bias. Circuit 50-24 derives the square root of its input signal, yielding a flow-velocity signal. A zero-and-span circuit 50-26 converts the varied input from device 50-24 into a signal having a desired voltage range starting at zero.

The output signal of flow sensor 50, taken from circuit 50-26, acts in the circuit of FIG. 2A, described above, to provide an actuating voltage to the voltage-to-pneumatic (E to P) actuator 44*a* of the damper or valve 44 (FIG. 1A).

As thus far described, the apparatus of FIGS. 1, 1A and 2 and the apparatus of FIGS. 1, 1A, 2A, 3, 3A and 3B provide for linear or proportional increase of air flow through the fume hood in relation to increasing area of the sash opening.

The device 50-2 of FIG. 3A includes regulating means for developing more rapid changes in the flow rate for sash adjustments above mid-range than below mid-range. An auxiliary spring 50-28 is arranged to modify the linear deflection of bar 50-14 that otherwise occurs in response to the differential pressures developing in flow cross 50-4. Auxiliary spring 50-28 is located closer than springs 50-18 to hinge 50-16 of bar 50-14; the upper end of auxiliary spring 50-28 is spaced from bar 50-14 when the sash is closed. Spring 50-28 is adjusted so that it is engaged by bar 50-14 when the sash opening is increased to approximately its mid-range position. Beyond the mid-range sash position, a larger increment of pressure difference must be developed in enclosure 50-10 for incrementally deflecting bar 50-14 than when that deflection is opposed only by springs 50-18.

The effect of the described non-linear operation of device 50-2 is to alter its output in response to flow cross 50-4. That altered output causes balance of the inputs to comparator 52 (FIG. 2A) to occur only as a result of changes of the flow rate in exhaust duct 42 that are greater per unit change of sash position above mid-range, roughly, than for sash adjustments units below mid-range.

The function of auxiliary spring 50-28 can be implemented in various ways. For example, spring 50-28 can be coaxial with spring 50-18*a* below bar 50-14 and spaced from the bar below mid-range sash positions. Omitting spring 50-28, spring 50-18*a* can be made non-linear, as by having a series of relatively soft convolutions that bottom against one another when the mid-range condition of the sash is reached and having further convolutions, stiffer than the soft series, that act alone in resisting deflection of bar 50-14 beyond its mid-range downward deflection.

The apparatus of FIGS. 3, 3A and 3B constitutes a volumetric flow rate sensor. By omitting spring 50-28, it can have a linear characteristic in response to flow rates that are developed over the entire range of sash openings or, by including spring 50-28, it can have a non-linear characteristic wherein the described more rapid increases in flow rates develop as the sash approaches and reaches it fully open position.

The described non-linear variation of the volumetric flow rate of a fume hood as a function of sash opening represents a distinctive improvement for fume hood fugitive material containment. This concept has no relation to incidental random deviations from linearity that may occur in devices such as the E-to-P actuator 44*a* and its linkage to valve 44, and uncompensated deviation from linearity of valve or damper 44.

As mentioned above, different air velocities develop at different areas of a sash opening. Many factors affect such disparities of the entering air velocities, notably the patterns of air turbulence in a fume hood and shifts that occur in patterns of turbulence. As a design concept, the velocity of the entering air should be great enough at all of its areas under ordinary conditions to capture fumes in the fume hood against escape into the laboratory room. Standards of safe average face velocities have been adopted for air drawn into fume hoods. As noted above, "average face velocity" is the average of the velocities of air entering all areas of a sash opening. The standards have been set high enough to take into account the patterns of entering air velocities and a range of ordinary prevalent and changing conditions of the space in front of a fume hood at various local positions in front of the plane of the hood sash opening. As shown below in connection with FIG. 4, reliance on proportional control of the flow rate versus sash opening is either wasteful at mid-range or inadequate when the sash approaches and reaches it fully open position.

Figure 4:
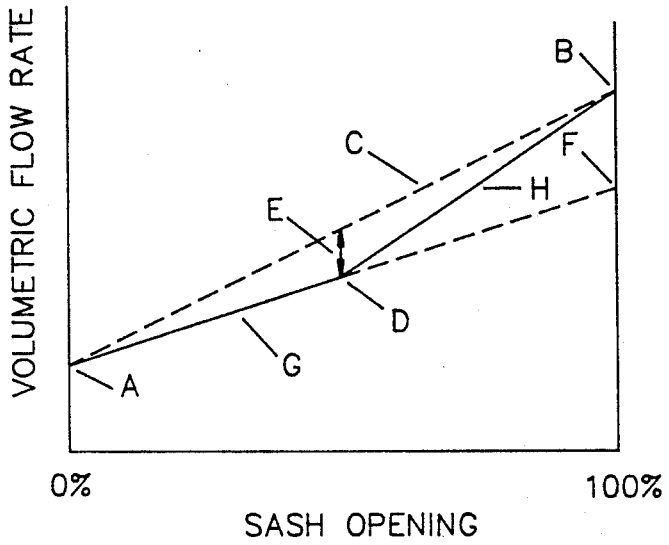
FIG. 4 is a graph representing the operation of the apparatus of FIG. 3 with and without the modification in the device of FIG. 3A.

In FIG. 4, flow rate A represents the flow of air through bypass passage 36*a* (FIG. 1A). Flow rate B is the flow rate for developing the average face velocity that is sufficient to capture fumes against escape from the fume hood when the sash is fully open, under ordinary circumstances. Proportional control would then result in flow rate C being developed at the mid-range position of the fume hood's sash. However, it can be demonstrated that a considerably lower flow rate D provides safe average face velocity at the mid-range sash adjustment, under ordinary circumstances. Excess E of the flow rate would result from using proportional control for the full range of sash adjustment, to include flow-rate B. On the other hand, if the proportional flow-rate control were set to develop flow rate D at the mid-range sash position, flow-rate F would be developed at the fully open sash position; that flow rate is much lower than the flow rate B needed to develop adequate average face velocity at the fully open sash position.

Flow rate B in the example is 50% higher than flow rate F. Obviously, flow rate F would be woefully inadequate. The excess E over the required mid-range flow rate D in this example is a wasteful 40%, approximately, with linearly increasing flow A-to-B.

The apparatus described above provides significant economy during the more frequent partially open uses of the sash, yet safety without waste is provided during the less frequent fully open uses of the sash.

Device 50-2 (FIG. 3A) is a practical embodiment of the invention for developing greater changes of the flow rate above the mid-range sash position, especially at and approaching the fully open sash position. However, in some respects it is preferable to provide the same or a similar type of non-linear characteristic electronically. All of the apparatus described above is utilized in an electronic alternative, except that spring 50-28 is omitted or a commercially available transducer is used, equivalent to that of FIGS. 3 and 3A omitting spring 50-28, and the circuit of FIG. 2A is replaced by that of FIG. 5. Components in FIG. 5 bear the same reference numbers as those used in other Figures to identify the same components. Their description appears above; that description is abbreviated below.

Figure 5:
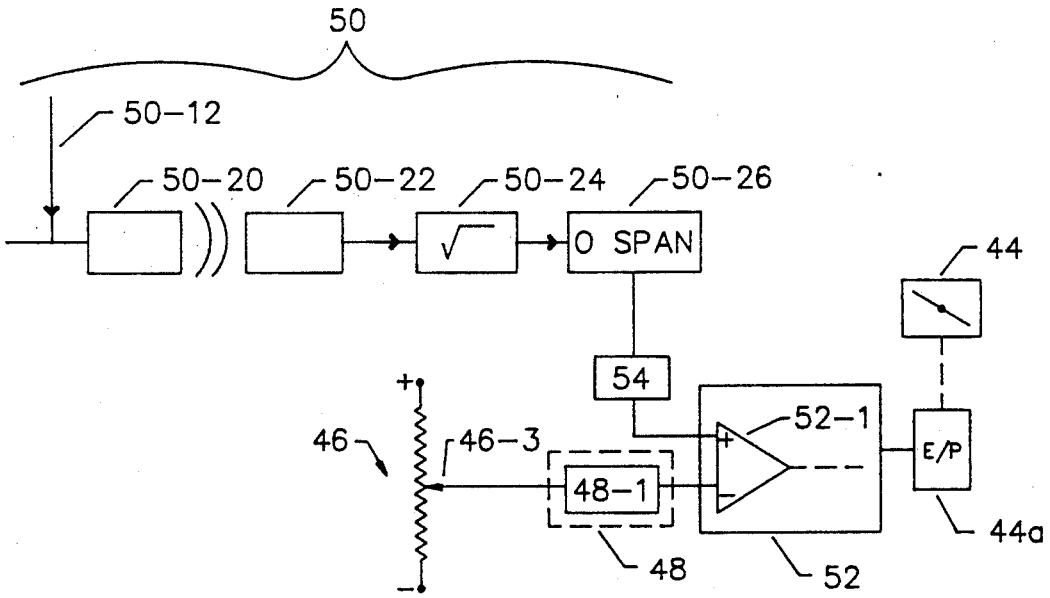
FIG. 5 is a block diagram of a known circuit, incorporating a novel modification, for actuating an air flow regulating valve.

In FIG. 5, magnet 50-20 is displaced by coupling device 50-12 so that the magnet is displaced linearly in proportion to the differential pressure developed in the flow cross 50-4 (FIG. 3). Hall-effect device 50-22 produces an output signal that is proportional to the displacement of the magnet. The device 50-22 is adjusted in position and its signal is appropriately biased so that its output is zero when there is no air flow. When air flows through the fume hood, either through the bypass passage 36*a* or through both the sash opening and the bypass passage, there is an output signal to circuit 50-24. That circuit derives the square-root of its input, so that its output represents flow velocity. That output is substantially proportional to the volumetric flow rate. Zero-and-span circuit 50-26 may be adjusted so that its output reaches a desired maximum at full flow and is zero at low flow when bypass air flows only in passage 36*a*.

Sash position transducer 46 in FIG. 5 provides an output signal that varies linearly with changes in sash position, and control circuit 48 (including zero-and-span circuit 48-1) supplies this signal to the (−) input of comparator 52-1 in control circuit 52 that energizes E-to-P device 44*a*.

The flow-rate representing signal at the output of circuit 50-26 is impressed on an adjustable non-linear converter 54, and the converter's output is applied to the comparator's (+) input. The output of device 52 shifts rapidly when the sash and the sash position transducer are moved, causing a large difference to appear at the comparator's input, in turn changing the output of circuit 52 to E-to-P device 44*a*. The flow rate is thus changed, restoring balance at the comparator's input. These changes slowly modifying the output of integrator 52-3 (FIG. 3) until, at equilibrium, a signal level is stored in the integrator representing the new sash position.

The characteristic of converter 54 a regulating means is such that its output rises roughly in proportion to its input until it reaches a level corresponding to the mid-range sash position, and above that level the output signal of converter 54 rises less in response to increases of its input than it does up to mid-range, resembling the effect of spring 50-28. The result is that the flow rate changes more rapidly in response to sash adjustments when the sash is more than half-open than when it is less than half-open.

Non-linear converter 54 may take various forms. A circuit having a log anti-log characteristic is appropriate for this purpose. The circuit whose block diagram is shown in FIG. 5 and having a suitable non-linear converter 54 provides an operating characteristic of flow-rate versus sash opening shown in FIG. 6. Letters A' through H' designate portions of the characteristic in FIG. 6 that correspond to like portions of the characteristic designed by letters A through H in FIG. 4.

Figure 6:
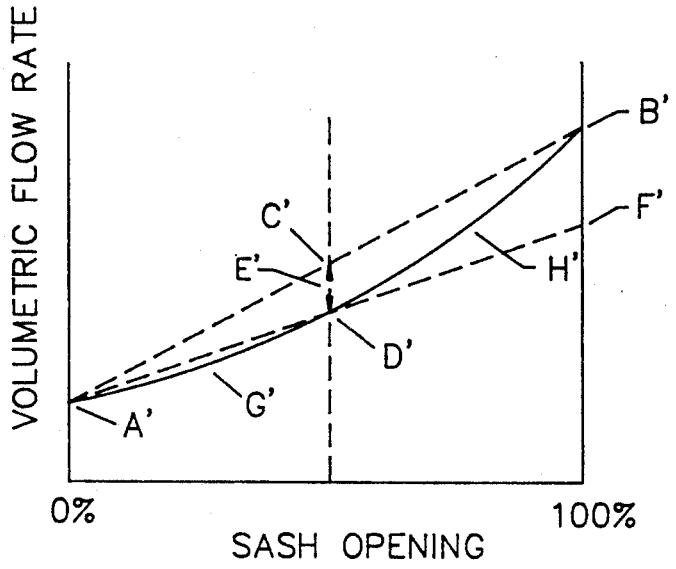
FIG. 6 is a graph illustrating the operation of the apparatus of FIG. 5 with and without the modification.

In FIG. 6, flow-rate A' is provided when the sash is shut. Flow rate B' represents a minimum flow rate for the fully open sash position, to provide a proper but not excessive flow rate. At mid-range of the sash, the flow rate D' is developed. Segment G' of the characteristic is a close approximation of flow rates needed to maintain proper face velocities up to mid-range of the sash adjustment. Segment H' provides the flow rates needed to provide proper face velocities above mid-range and as the sash approaches and reaches its fully open position.

If proportional control of flow rate versus sash opening were used for the range A' to D', the face velocity at flow-rate F' would be seriously deficient compared to flow rate B', hence unsafe near and at the fully open sash position. If proportional control were used for the range A' to B', an excessively high flow rate C' would result at mid-range, substantially higher than needed to develop adequate face velocity. The excess E' of flow rate C' over flow rate D' represents costly waste of conditioned air. In an example (illustrated in FIG. 6, drawn to scale), the excess E' of flow rate at mid-range is 30% larger than flow rate D'. Segment H of the curve represents flow rates that increase at a significantly greater-than-proportional rate as the sash approaches and reaches its fully open position. The increase from F' to B' in this example is 36%. Ample face velocities are provided in the range from D' to B'.

The controlled non-linearity of the characteristic of flow rate versus sash position is introduced mechanically into the flow-rate sensor 50 of FIGS. 3, 3A and 3B. That non-linearity is introduced electronically into the feedback electrical channel in FIG. 5, between a linear flow-rate sensor 50 and device 52, to be balanced against the linear channel from the sash-position transducer to the device 52. It is evident that the sash position transducer can be formed to provide the desired non-linearity, or its coupling to the sash can incorporate a cam or like device to introduce the desired non-linearity. Moreover, circuit 54 in FIG. 5 can be omitted and, instead, an appropriate non-linear circuit may be interposed in the channel between sash position transducer 46 and the (−) input of device 52. Such alternatives are contemplated for developing more rapid decreases in the flow rate as the sash approaches and reaches its fully open position than the more gradual rate of increase in the flow rate as the sash is moved up to its mid-range position.

The improvement in control of volumetric flow rate of fume hoods, discussed above, is particularly effective in fume hoods of the type in FIGS. 1 and 1A, where the sash is moved vertically in increasing the sash opening. In such fume hoods, the exhaust port is at the top of the fume hood; and the extent of the sash opening is accurately indicated by a sash position sensor. However, the described variations in flow rate versus sash opening is also applicable to fume hoods in which the sash is moved horizontally for adjusting the sash opening.

Figure 7:
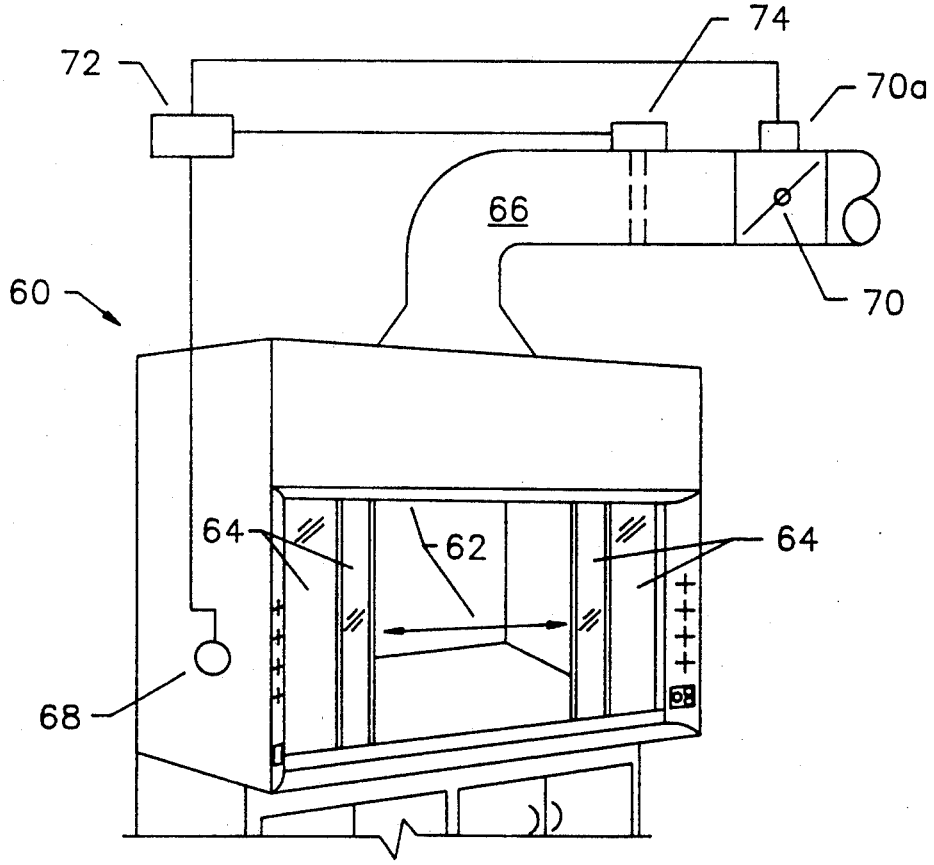
FIG. 7 is a perspective view of a known fume hood having a horizontally adjustable sash, including a diagrammatically shown control circuit for its exhaust valve.

In FIG. 7, fume hood 60 of typical construction has the usual six walls including a front wall that provides a sash opening 62. Sash 64, comprising various combinations of horizontally sliding panels, is an adjustable closure for the sash opening. Exhaust is drawn out of the fume hood via duct 66. This form of fume hood is not readily adapted to measurement of the sash opening by means of a sash position transducer. Instead, a so-called "face velocity" sensor or "through-the-wall" air velocity sensor is used to monitor the flow rate of air passing through the fume hood and to control the volumetric flow rate. For example that sensor, thermally compensated for room temperatures, generally designated 68, comprises an air passage extending from an external port to an opening inside the fume hood, and the sensor comprises an electrically heated element that is cooled variably in dependence on the velocity of the air in the passage.

The flow rate of the exhaust may be controlled variously, as by adjusting the speed of an exhaust blower, the pitch of inlet guide blades on a vortex damper of a centrifugal fan, by a throttling damper at fan inlet or discharge or, as in the illustrative apparatus, by means of a variable air valve (VAV) or damper 70 in an exhaust duct. Damper 70 is operated by an electric-to-pneumatic ("E-to-P") actuator **70*a* (as in FIG. 1A). Control circuit 72 responds to air velocity sensor 68 and controls damper 70. In ordinary practice, when the sash opening is increased, the air velocity through sensor 68 tends to drop; but a control that responds to the difference between the output of flow sensor 68 and a set point activates the damper to increase the flow rate until the output of the air velocity sensor 68** equals the set point.

Treating the velocity of the air flowing past sensor 68 as fairly reflecting the average face velocity at the sash opening in its various adjustments, the volumetric flow rate through the fume hood is customarily increased in proportion to increasing openings of the sash. Here, however, for assurance of maintaining adequate capture velocity as the sash starts to open and until it becomes fully open, essentially constant face velocity is maintained up to mid-range of the sash opening and the face velocity is increased progressively and more rapidly as the sash opening increases from about mid-range to fully open condition. This variation of the face velocities versus the sash openings is the "controlled non-linearity" defined above.

Control circuit 72 responds to air velocity sensor 68 for controlling VAV box actuator **70*a*. Various forms of regulating means may be provided in the apparatus that controls the exhaust flow rate for imparting the controlled non-linearity described above. A flow sensor 74 in the duct provides a flow rate signal. Sensor 74 may be a non-linear device in the form shown in FIGS. 3, 3A and 3B, including spring 50-28 for developing the controlled non-linearity of the flow rate. However, sensor 74 may be a commercially available linear flow velocity sensor, e.g. that of FIGS. 3, 3A and 3B, omitting spring 50-28 and the controlled non-linearity of the apparatus in FIG. 7 can be introduced electronically as in FIG. 8**, without dependence on mechanisms.

Figure 8:
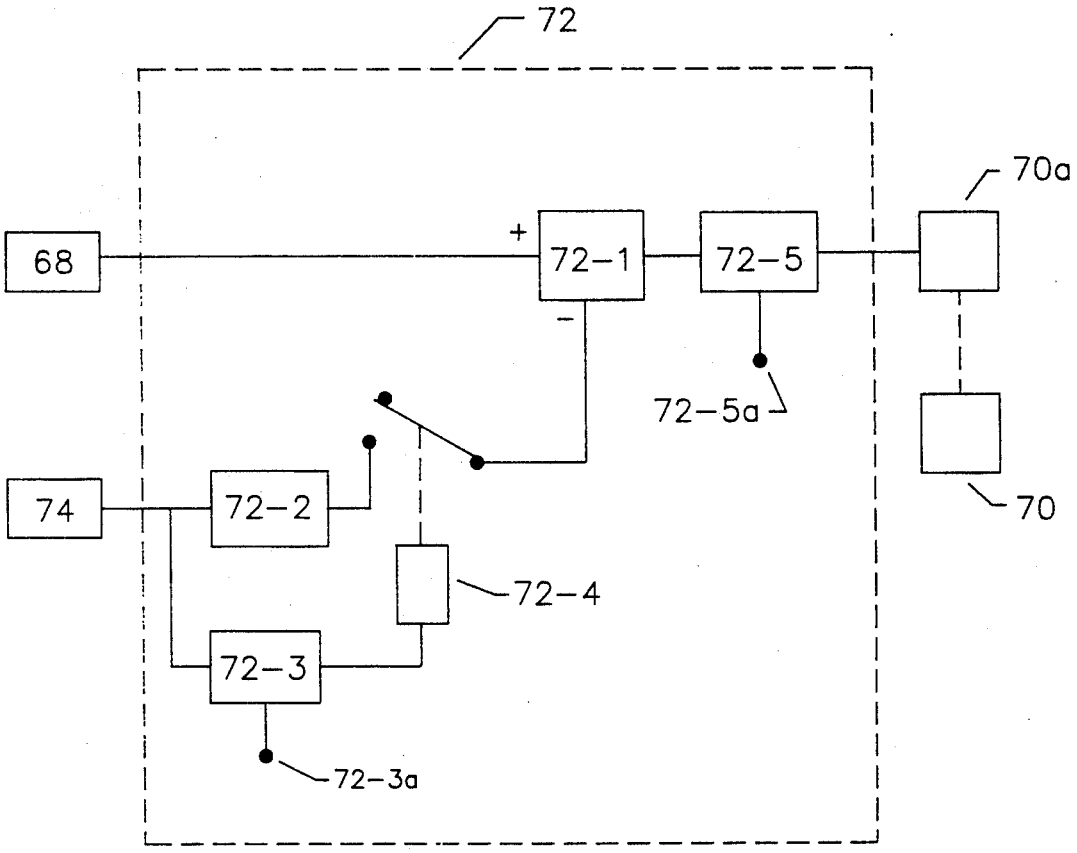
FIG. 8 is a block diagram of a novel circuit for controlling the flow rate of the fume hood of FIG. 7.

Circuit 72 in FIG. 8 includes a summer 72-1 for adding—or for averaging—signals from air velocity sensor 68 and from flow rate sensor 74. A zero-and-span circuit 72-2 at the output of flow rate sensor 74 is adjusted to be zero at mid-range of the sash opening. Contacts of a relay 72-4 are interposed between zero-and-span circuit 72-2 and summer 72-1. Relay 72-4 is diagrammatically represented as a mechanical device; in practice, it would usually be a functionally equivalent device electronic. A level detector 72-3 compares the output of flow rate sensor with bias voltage at set-point **72-3*a*, a reference level. When that level is exceeded, level detector 72-3 is triggered to energize relay 72-4**.

So long as the the contacts of relay 72-4 remain open the output of summer 72-1 is determined only by air velocity sensor 68. Circuit unit 72-5 responds to the output of the summer for developing a voltage for energizing E-to-P actuator **70*a* of damper 70**.

Circuit unit 72-5 is well known; it is the same as circuit 48 FIG. 2A. This circuit includes a comparator arranged to compare its input voltage with the voltage at set-point input 72-5 and also includes an amplifier that provides appropriate gain and provision for integrating the unbalance output signal of the comparator. The overall effect of circuit 72-5 is to provide an energizing voltage to E-to-P actuator **70*a*, such that the output of summer 72-1 matches the level of set-point 72-5*a*. So long as relay 72-4 is open, circuit unit 72-5 responds only to air velocity sensor 68. After relay 72-4 closes, the combined effects of sensors 68 and 74 are represented at the input of circuit unit 72-5**.

When the sash is adjusted from being shut to being partway open, e.g., 40% or 50% of the full sash opening, the entire apparatus of FIG. 8 provides air flow rates that are proportional to sash openings. The signal from air velocity sensor 68 is transmitted via summer 72-1 as input to controller 72-5. That input is compared to a reference voltage at set-point **72-5*a* which represents the desired average face velocity. As a result of the comparison, the voltage output of circuit unit 72-5 may vary, changing the flow rate of the exhaust. At equilibrium, the output of circuit unit 72-5 is stable at that voltage needed to maintain a constant air velocity in sensor 68. If the sash opening is increased, the air velocity past sensor 68 decreases, and a difference develops between the inputs to control unit 72-5. That difference causes an increase in the voltage to actuator 70***a*, causing an increase in the flow rate, and changed output from circuit unit 72-5 until equilibrium is restored. Accordingly, the signal from sensor 68 remains constant at equilibrium for all values of the exhaust flow rate between zero sash opening and the point at which relay 72-4 is actuated. Sensor 68 provides a signal representing constant average face velocity for that range of sash openings.

At some point in the progressive opening of the sash, for example midway, the flow rate as measured by sensor 74 increases to the value that causes level detector 72-3 to close relay 72-4. At that point, zero-and-span circuit 72-2 (as adjusted) produces zero output. Above that point, voltage from the zero-and-span circuit 72-2 is applied to summer 72-1. The output from air velocity sensor 68 is applied in the positive sense to summer 72-1, and increases in output from flow rate sensor 74 are applied in the negative sense to summer 72-1, as indicated by the (+) and (−) symbols.

The net effect of control 7 is to simulate abnormally low air velocities at sensor 68 after relay 72-4 closes. Accordingly, in overcoming the simulation of low air velocity at sensor 68, the flow rate increases more rapidly with increasing sash opening than it did when the proportional control was in effect, at small sash openings. The effect of input to summer 72-1 from flow sensor 74 is cumulative, developing a curve resembling segment H in FIG. 4. Consequently, as the sash opening approaches and reaches its fully open condition, the volumetric flow rate through the fume hood increases substantially faster than the more gradually increasing flow rate that occurs in the lower range of sash openings, approximately up to the mid-range opening.

In the foregoing description of the apparatus of FIG. 7, in which control circuit 72 is that shown in FIG. 8, sensor 68 is a conventional air velocity sensor and flow rate sensor 74 is a device and circuit, also conventional, for providing an output signal that varies linearly with the flow rate in duct 66 (FIG. 7). So long as relay 72-4 has not been actuated, the flow rate in duct 66 increases with increasing opening of the sash to the extent required to maintain constant air velocity at sensor 68. Relay 72-4 closes when the sash opening is increased beyond its halfway open position, in the example considered above; then the following effect occurs.

The average face velocity at sensor 68 increases, and the signal from flow rate sensor 74 also increases. The resulting signal from summer 72-1 simulates low velocity at sensor 68 at the input to controller 72-5. As a result of the changes of both signals that are summed or averaged, the signal level input to control circuit 72-5 decreases, leading to still further increase in the output signal to E-to-P actuator 70*a*. In turn, the air velocity at sensor 68 and the flow rate at sensor 74 increase further and still further changes occur, theoretically, in the signal output of sensors 68 and 74. However, that progression is self-limiting for ordinary parameters of the apparatus. The increasing flow rates resulting from increased signals to E-to-P actuator 70*a* may be regarded as an output "signal" that is fed back in a positive or regenerative sense to sensors 68 and 74 at the input side of control circuit 72 (FIG. 8). However, the "loop gain" of the feedback effect is less than 1.0 using ordinary values and proportions of the components. Consequently, the flow rate and the average face velocity attain asymptotic limits at successive adjustments of the sash in the range of sash openings between the halfway open sash position and the fully open sash position. Both the general slope and the curvature of the operating characteristic (like segment H' in FIG. 6) can readily be varied. A prominent factor in this respect is the adjustment of the range of the signal from zero-and-span circuit 72-2 in relation to the range of the signal from sensor 68.

The inclusion of circuit elements 72-2, 72-3 and 72-4 is optional. The contribution of flow rate sensor 74 as an input to summer 72-1 may, if desired, commence as soon as the sash starts to open. A curve like that of FIG. 6 would result; its curvature is optimized by varying the circuit values.

Both when control circuit 72 is used to provide proportional increases of flow rate with increasing sash opening and when non-linearity is introduced, the apparatus of FIG. 8 includes a single air velocity sensor 68 for providing a representation of the average face velocity. To obtain a rigorously accurate measure of average face velocity would require an impractical arrangement of many flow sensors distributed everywhere in the sash opening. It has been customary to use a single "face velocity" sensor in a wall of a fume hood.

Figure 9:
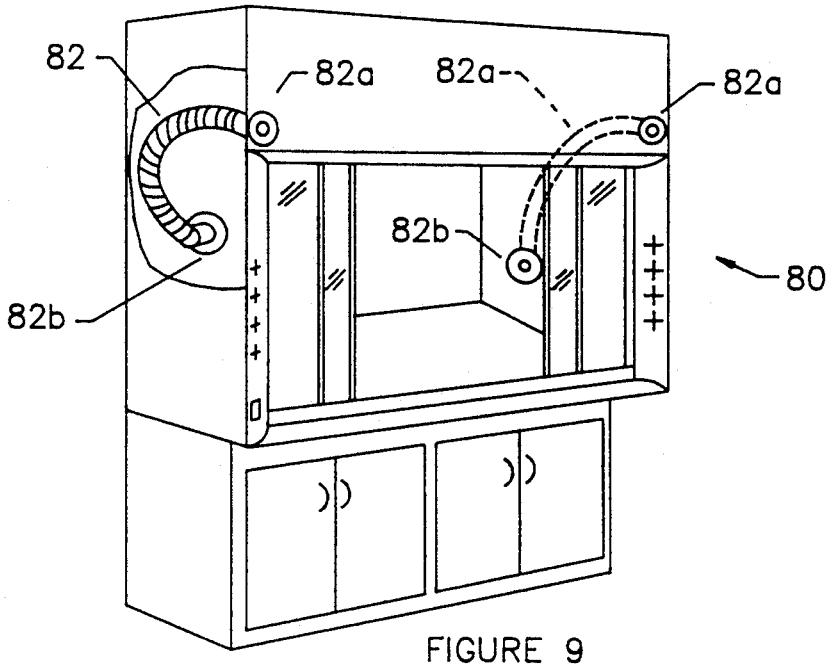
FIG. 9 is a perspective view of a fume hood like that in FIG. 7, with an improvement.
Figure 9A:
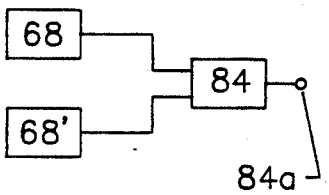
FIG. 9A is a block diagram of a circuit for adapting the circuit of FIG. 8 for use with the manifold of FIG. 9.

The fume hood of FIGS. 9 and 9A includes two air velocity flow sensors as a vast improvement over the single air velocity sensor used heretofore. The output of a single air flow sensor has been assumed to be a reliable representation of the average face velocity of a fume hood. However, that assumption ignores changing conditions; it is invalid in varying degrees when changing conditions are taken into account. There are complex patterns of turbulence inside a fume hood. Those patterns and the air flow patterns apart from turbulence are affected by various factors, such as changes in the sash opening, and asymmetries such as those developed by a person walking past a fume hood. An additional air velocity sensor distinctively provides a substantial degree of immunity to the effects of changing conditions. Two such flow sensors spaced far apart, as further described below, provide a much truer average face velocity signal.

FIG. 9 shows a fume hood 80 with two air velocity sensors in its opposite side walls, respectively. Each of the side walls is hollow, having spaced-apart panels, and a flexible tube 82 is disposed between the panels of each side wall. Each tube 82 has a port 82*a* open to the space in front of the fume hood. Accordingly, multiple fume hoods can be installed side-to-side, abutting one another. At the inner ends 82*b* of tubes 82, in openings into the fume hood's interior there are respective air velocity sensors such as the type mentioned above.

Each air velocity sensor includes the passage provided by the tube 82, its opening 82*a* into the laboratory room, its opposite-end opening 82*b* into the fume hood, and the sensing element in the passage. Each sensor may be regarded as being located, in effect, at the inner-end opening 82*b* of tube 82. The two openings 82*b*, and effectively the two air velocity sensors in tubes 82, are remote from each other, in this example being located at opposite sides of the fume hood's interior. The fume hood's face velocity is much more faithfully represented by two such air velocity sensors than could possibly be provided by a single air velocity sensor. This result may be attributed to their wide separation, specifically at opposite sides of the fume hood. The disposition of the two openings 82*b*, respectively high and low in the fume hood, contributes further toward a more valid representation of the fume hood's average face velocity.

Multiplying the air flow sensors beyond two could improve the immunity of air velocity sensing to changing conditions, and to a more faithful representation of the fume hood's average face velocity. However, the increased cost associated with additional flow sensors seems unwarranted.

FIG. 9A shows multiple flow sensors 68 and 68' (disposed but not shown in ports 82b of FIG. 9) connected to a summer 84. Alternatively, this may be an averaging circuit. Its output terminal may be connected to the (+) input of summer 72-1 (FIG. 8). It may be preferable to connect sensors 68 and 68' directly to summer 72-1, omitting summer 84.

Figure 10:
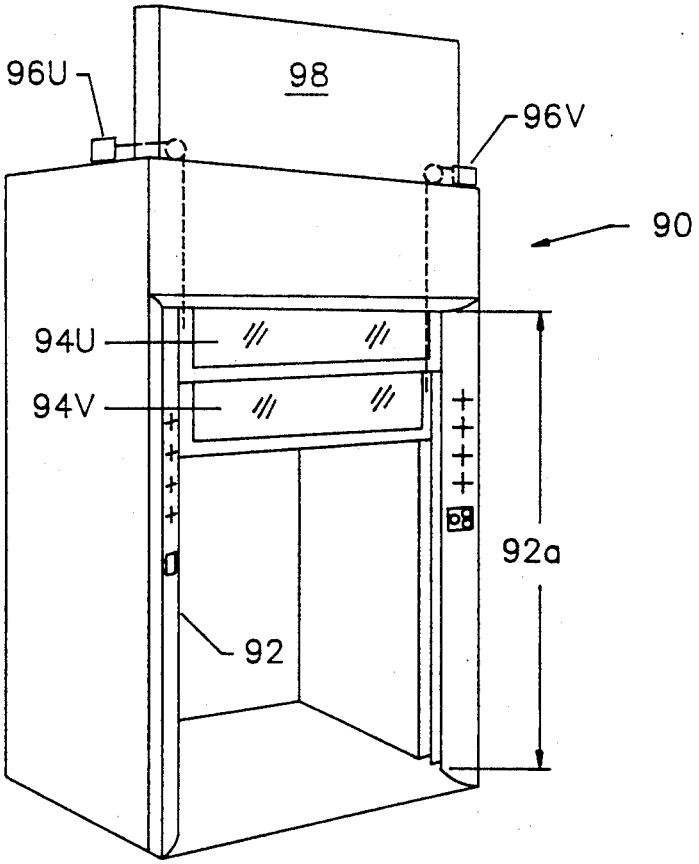
FIG. 10 is a perspective view of a known "walk-in" fume hood having a two-panel vertically adjustable sash.

FIG. 10 shows a fume hood 90 like that in FIGS. 1 and 1A, except that fume hood 90 is a "walk-in" fume hood having an opening 92 whose height is so large that a single vertical-sliding sash would be impractical. Instead, two panels 94U and 94V in FIG. 10 slide vertically in their respective tracks. Fume hood 90 has means (not shown) providing a bypass passage corresponding to passage 36a in FIG. 1A. Panels 94U and 94V complement each other; they serve as a composite sash. Sash cap 98 receives and encloses both panels when the sash is fully open.

Fume hood 90 is equipped with novel means for providing signals that represent the fume hood's sash opening. Each panel 94U and 94V has a respective sash position signal generator, such as transducers 96U and 96V which may be potentiometers coupled by cables to the respective panels.

Signals U and V from potentiometers 96U and 96V, respectively, provide input to network 100 in FIG. 10B. That network yields an output signal representing the height or the composite heights of the sash opening or openings for all possible relative adjustments of panels 94U and 94V. Network 100 is structured in accordance with tabulated control logic that forms a portion of FIG. 10B.

FIG. 10A diagrammatically illustrates all possible relationships of panels 94U and 94V, whether in the fume hood opening 92a or received partly or wholly in sash cap 98. Each panel has a height S which is half the height of the fume hood opening 92a. The characters U and V designate the sash positions and the dimensions or heights of the lower edges of panels 96U and 96V above the sill or lower edge of opening 92.

Parts I through VI of FIG. 10A represent relative positions of the panels in all possible adjustments. Parts I and II of FIG. 10A show heights U and V as less than the height S of a panel; parts III and IV show heights U and V as being greater than height S of a panel; and parts V and VI show the heights U or V of one panel or the other being less than height S when the height of the companion panel is greater than height S Network 100 includes a logic switching matrix 102 having two input lines designated U and V for corresponding signals provided by sash position transducers 96U and 96V, and a third input line S for a correspondingly designated constant reference signal S. Signals U and V are related so that each has a maximum of twice the reference signal S.

Switching matrix 102 has six "output" or control lines 104–109 for relays 110–115, respectively. The term "relay" means a relaying device that is, or is analogous to, a mechanical relay having normally open contacts or a normally open signal transmission channel, the contacts being selectively closed or the transmission channel being rendered conductive in dependence on control signals on lines 104–109.

Network 100 also has four summers 117–120 for combining signals U, V and S in the manner shown in the drawing.

Signals U and V are transmitted via lines 121 and 122 to the respective signal transmission channels of relays 110 and 111. The output signals of summers 117–120 are transmitted via respective lines 123–126 to the contacts or signal transmission channels of relays 112–116, respectively. In this example, analog signals are used, but digital signals are an alternative.

The output signal transmitted by each of the relays or relaying devices 110–115 (selected as described below) is applied to zero-and-span circuit 128 to provide an output appearing at terminal 130. That output represents unobstructed the magnitude of the sash opening; it is useful as a substitute for sash position transducer 46 in FIGS. 2, 2A and 5.

In the "control logic" matrix 102 of FIG. 10B, symbol A represents all heights of the two panels 94U and 94V in which U is greater than V, considering the separation of the panel's lower edge from the sill of fume hood opening 92a. Symbols B and C represent all heights of the respective panels when U or V is greater than S, i.e., more than half of the fume hood opening 92a. Symbol D represents the condition of U being greater than height V plus S. Finally, symbol E represents the height V being greater than U plus S.

Adjacent to each output line 104–109 of logic matrix 102 are various characters A–E, some of these characters having lines above them and others with no such line. "$\overline{A}$" means "not A". "C" means "if C is available". This is the notation of Boolean algebra. If a full "truth table" were laid out, it would include many more items than A–E in this "Control Logic" of FIG. 10B. However, many items of an exhaustive list prove to be redundant. One and only one relay of the series 110–116 is activated to "close" its "contacts" in dependence on which of the Boolean algebra notations on its control lines 104–109 is valid. It would be a verbose and needless exercise to go through all of the analysis leading to the formation of network 100.

Operation of the apparatus of FIGS. 10, 10A and 10B may be summarized as follows.

1. Signals are developed on lines 121–126—either directly as on lines 121 and 122 or indirectly via summers 117–120; those signals represent the relationships of panels 94U and 94V in all conditions, typically those in FIGS. 10A, I–IV;

2. Control matrix 102 develops control signals for relays 110–115 for all relationships of signals U and V such that only one of those relays is enabled or activated to transmit signals; and 3. A signal is developed in a common output channel of the relays to terminal 130.

The resulting signal simulates the position of a single sash as in FIGS. 1 and 1A. That signal is useful in place of the single sash position transducer in FIGS. 2 and 2A. This is true both when regulating means is included in the exhaust flow rate control apparatus (e.g. converter 54 in (FIG. 5) for imparting the controlled non-linearity discussed above and when the flow rate is to be proportional to the sash opening.

In this apparatus, signals U and V are provided by transducers 96U and 96V, representing the heights of each of the panels 94U and 94V. Signals are provided by control logic 102 and summers 117–120 that represent the relationships between the adjusted positions of the sash panels. A signal is derived representing the unobstructed portion of the sash opening.

Figure 11:
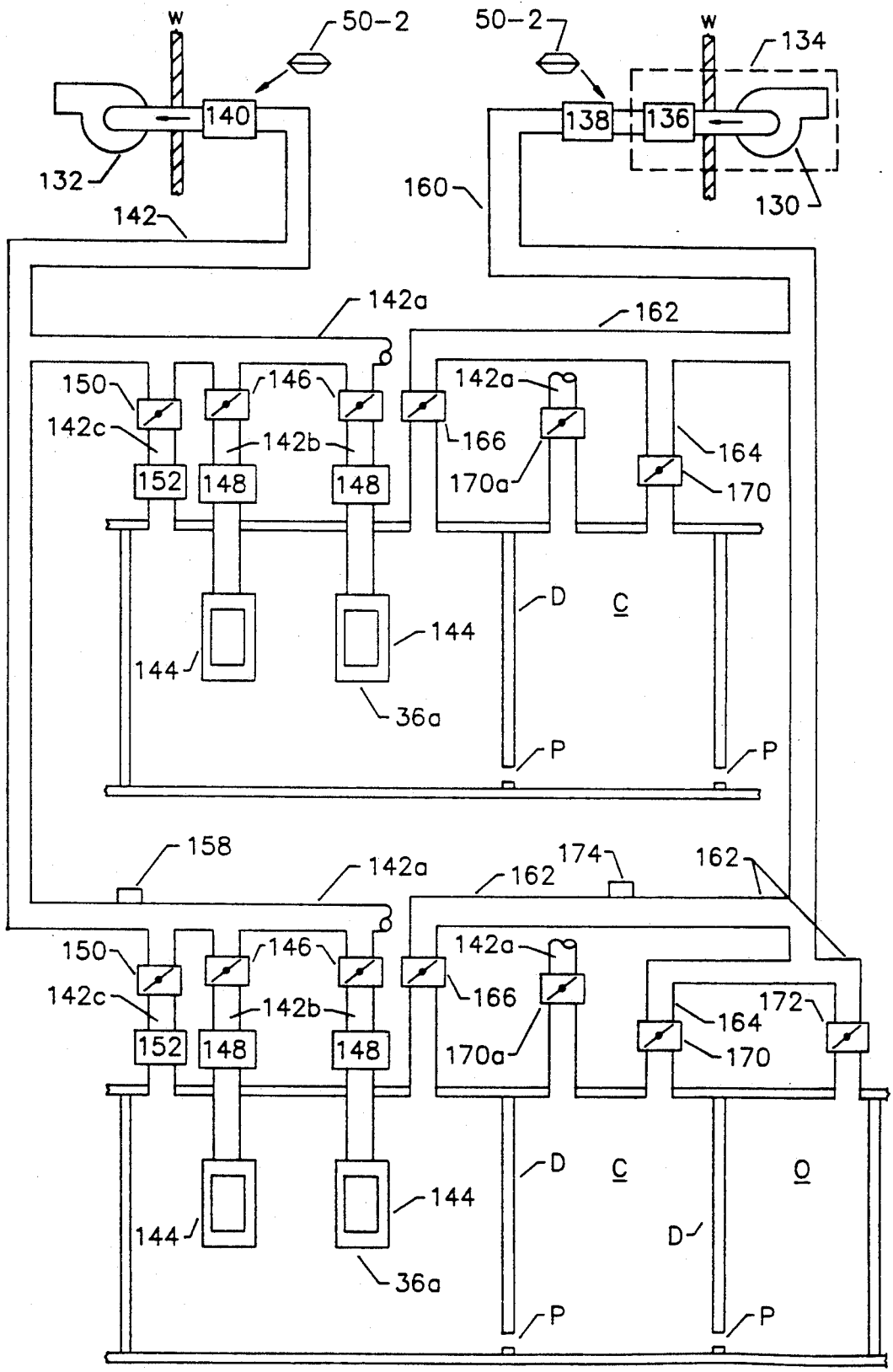
FIG. 11 is a diagram of a novel air flow system including laboratory rooms having fume hoods.

FIG. 11 diagrammatically illustrates an air flow system of a laboratory building module including a supply fan 130 for drawing air into the building module through wall W and an exhaust fan for expelling exhaust air outside wall W. In the following description, what is said in reference to a laboratory building applies as well to a laboratory subdivision of a building served by the described air flow system. As indicated above, the term "laboratory building module" or, briefly, "laboratory module", applies both to a entire laboratory building and to such laboratory subdivision of a building.

A laboratory building (or a laboratory building module) normally has not only a number of laboratory rooms, but residual areas such as corridors or other spaces adjoining laboratory rooms; the residual areas provide "spill" into or out of the laboratory rooms for developing positive or negative pressure in the laboratory rooms relative to such adjoining areas. The laboratory building may also have some rooms for non-laboratory purposes that require a supply of comfort-conditioned air; the air supply to each such room is controlled by a room thermostat, and those rooms discharge their exhaust into the same corridors or other residual areas that adjoin the laboratory rooms. All such rooms may be called "offices" as a convenient term of reference.

The areas served by the illustrative air flow system of FIG. 11 may be divided into two categories.

Laboratory rooms receive comfort-conditioned air directly from the supply duct; such direct air supply is regulated in response to the local conditions in each laboratory room. Office rooms correspondingly receive their supply of air from the supply duct in response to local conditions, normally a room thermostat. All rooms that receive some or all of their air supply directly from the supply duct under local-condition control constitute one category of rooms.

Another category of areas of the laboratory building also receive their air supply from the supply duct, namely "residual areas" such as corridors and analogous spaces. Control of the air supply to residual areas in FIG. 11 is not subject to local conditions of any particular area. The pressure prevailing in the residual areas of the building should be neutral in relation to the ambient atmospheric pressure, this condition being called "neutral building pressurization".

Fans 130 and 132 in FIG. 11 are "variable capacity fans"; they may be variable speed blowers, or fans having variable-pitch blades, or each of them may comprise a fan or a blower together with an adjustable damper.

The variable capacity supply fan 130 is here part of an air handler 134 that incorporates conventional apparatus 136 for preconditioning air to a desired humidity and a preconditioned temperature, such as 56° F. Air entering the rooms and corridors passes local heaters (not shown) that raise the temperature of the entering air to a comfort level.

Flow sensors 138 and 140 provide electrical signals that are proportional to the main supply and exhaust flow rates of the laboratory module. These flow sensors in an example are the kind shown in FIGS. 3, 3A and 3B except that the non-linearity inducing device 50-28 of FIG. 3A should be omitted from flow sensors 138 and 140.

The exhaust duct system includes a main duct or trunk 142, branch ducts **142*a*, individual ducts 142*b* of fume hoods 144 in the laboratory rooms LR, and individual room exhaust ducts 142*c* of the laboratory rooms. Each fume hood duct 142*b* has a variable damper or VAV box 146, and it may have a flow rate sensor 148. Each laboratory room duct has a damper 150 having either on/off or proportional response to a room thermostat and, optionally, a flow sensor 152. While only one duct 142*c* per room is shown, two or more ducts may be used for room ventilation, and each duct 142*c*** should have its flow damper and, optionally, its own flow sensor.

When the sashes of all the fume hoods are shut, there is a sustained flow of exhaust due to open foil passages **36*a* of the fume hoods and any other air leaks into the fume hood. When one or more sashes are open partway or fully, their related dampers 146 are adjusted to provide increased flow rates. The total exhaust from any laboratory room is the total of the fume hood exhausts plus the thermostat-controlled exhaust from that room. The variable capacity exhaust fan 132 is adjustable for maintaining at least the minimum negative differential between the outlet side of a damper 146 and its laboratory room to produce the desired maximum flow rate of fume hood exhaust. The actual negative pressure in the duct varies at different locations and under various conditions of exhaust flow from the fume hoods and the laboratory rooms. In the illustrative exhaust flow system, the variable capacity fan 132 is responsive to the static pressure sensor 158. That sensor is located approximately at an individual exhaust duct 142*b* or 142*c*** which is most pneumatically remote from the exhaust fan in the exhaust duct systems, for assuring maintenance of an adequate negative pressure differential at all exhaust control valves.

The supply duct system extends from intake flow-rate sensor 138 to both categories of laboratory building areas, the local-condition controlled rooms and the residual areas. The air supply duct 160 from air handler 134 is divided into local-condition controlled area supply ducts 162 and residual area supply ducts 164. A variable air valve or damper 166 controls the rate of air flow from supply duct 162 into each laboratory room; a variable air valve or an on-off air valve or damper 172 controls the rate of flow from supply duct 162 into each office room; and a variable air valve or damper 170 controls the rate of flow from supply duct 164 into the residual areas, or (as in FIG. 11) there may be multiple dampers 170 having coordinated controls. In the illustrative supply duct system, the variable capacity supply fan 130 is responsive to static pressure sensor 174. That sensor is located in the supply duct system approximately at a valve 166, 170 or 172 which is most remote pneumatically from the supply fan, for providing assurance of adequate positive pressure differential at all the supply valves. Each supply damper 166 of a laboratory room is responsive to a signal representing the aggregate flow of exhaust out of that laboratory room, i.e., the sum (or the average) of the fume hood exhaust flow rates and the room exhaust rate. Accordingly, the air flow provided by the supply duct to each laboratory room is regulated in relation to the actual aggregate exhaust flow rate of that room. The flow rate of air from the supply duct is purposely made slightly lower or higher than the aggregate exhaust flow rates of each laboratory room. A flow rate into a laboratory room LR that is lower than its aggregate exhaust flow rate is used to provide a safeguard against a potentially contaminated air flowing from the room into its corridor. A flow rate of air into a laboratory room from the supply duct that is greater than its aggregate exhaust flow rates is used to provide a safeguard against air-borne particles entering the room from the corridor.

The differential pressure between the inlet and discharge sides of any of the VAV boxes (laboratory room-to-exhaust duct or supply duct to offices and corridors and laboratory rooms) in practice may be any value from ⅛ to 6 inches of water. This may vary depending upon the degree that the damper or VAV box is open and depending on the location of any particular damper or VAV box in relation to the static pressure sensor of the supply duct system or the exhaust duct system. The pressure differential between a laboratory room and the adjoining corridor or other residual area is typically 0.001 inch of water. There is practically no pressure differential between a laboratory room and the space within a fume hood when the sash is open, whether partially or fully open.

The difference between the aggregate exhaust flow rate and the supply duct flow rate is made up by air entering a laboratory room from its corridor C (infiltration) or leaving the room and entering the corridor (exfiltration). That difference or "spill" passes through somewhat constricted passages, typically passage P under door D, to sustain the room's pressurization.

It may be considered that the air flow system of FIG. 11 is applied to a laboratory building module in which the laboratory rooms are largely or exclusively intended for "wet chemical" procedures, accordingly being negatively pressurized, and in which the aggregate flow rate of all office rooms is relatively small, smaller than the aggregate spill to all the laboratory rooms. This is the most common condition in "wet" chemical laboratory building modules.

The total of all the flow rates of exhaust from all the laboratory rooms constitutes the aggregate exhaust flow rate in main exhaust duct or trunk 142 in the air flow system of FIG. 11 as thus far described. The total flow of air in the main supply duct or trunk 160 comprises two categories of flow, those flows that are subject to local-condition control (laboratory rooms and offices in FIG. 11) and the flow of air directly from the supply duct system into the corridors and other residual areas. In that described air flow system of FIG. 11, the aggregate exhaust flow rate is determined entirely by the aggregate exhaust flow rates of all the laboratory rooms, and is regulated solely by control of all of the exhaust VAV boxes 148 and 152. The flow rates of air directly from the supply duct system to the laboratory rooms and to the offices are also regulated solely by local conditions that control all of the dampers 166 and 172. However, there is no such local-condition control over VAV boxes 170 that regulate the direct flow of air from the supply duct to the residual areas.

The total flow rate in the main supply duct or trunk 160 as measured by sensor 138 is maintained in balance with total exhaust flow rate in the main exhaust duct or trunk 142 as measured by sensor 140 for maintaining neutral laboratory module pressurization in the corridors and other residual areas. The total of all the exhaust flow rates is determined b conditions in the laboratory rooms. The total flow rates of all air supplied to the laboratory rooms and the offices is less than the total exhaust flow rate. Balance is achieved by regulating VAV boxes 170 s that the flow rates of air supplied directly to the residual areas when added to the flow rates of air supplied via VAV boxes 166 and 172 directly to the laboratory rooms and the offices (the total supply rate) equals the exhaust flow rate. There is no tendency of outside air to be drawn into the residual areas of the building, and there is no tendency of comfort-controlled air to be expelled from the residual areas of the building. The net result is to leave the residual areas in a condition such that the building's air supply system does not have a tendency to develop an air flow anywhere except into the exhaust duct. This signifies neutral pressurization of the residual areas.

If slight positive pressurization of the above-described laboratory building module were desired, it could be achieved by regulating dampers 170 to adjust the supply flow rate to the residual areas to be somewhat greater than that needed as part of the spill drawn into the laboratory rooms. That controlled imbalance of the main supply flow rate as compared to the main exhaust flow rate would result in air from the residual areas being expelled from the laboratory building module, recognizing the fact that the building structure is not sealed so that such flow can occur through constricted passages through walls and windows and building porosity.

An unusual situation that can develop in wet-chemical laboratories is that there is only a small aggregate amount of air infiltration or spill into the laboratory rooms, or a relatively large volumetric discharge of air from offices and like rooms into the residual areas. In that situation, the intake flow rate of the building would exceed the flow rate from the exhaust. Neutral building pressurization can be established in that situation by regulating each VAV box **170*a* which is connected to the exhaust duct 142*a*, to dispose of the excess or unbalancing air volume appearing in the residual areas, e.g., corridors C, from the offices. Spill out of some positively pressurized laboratory rooms and into the residual areas can also be discharged via VAV box or boxes 170*a*** in like manner, as may be needed for maintaining neutral building pressure.

As noted above, a certain pressure drop is needed between the inlet and the delivery sides of exhaust control VAV boxes 148 and 152 and of supply control VAV boxes 166, 170 and 172 and all others connected to the supply duct 164, for those valves to function as intended. Static pressure sensor 174 is installed in the supply duct system 160, 162, 164 at a location remote from air handler 134 (most remote with respect to pneumatic pressure). Correspondingly, static pressure sensor 158 is installed in the exhaust duct systems 142, **142*a*, 142*b* and 142*c* at a location that is pneumatically most remote from exhaust fan 132. The capacity of the intake fan 130 and the capacity of exhaust fan 132 are adjusted to maintain the static pressure at sensors 174 and 158 respectively equal to a fixed set-point, sufficient for the VAV boxes and other air valves to provide the regulated air flows. So long as a fixed pressure is maintained at the inlet sides of the various air valves, their flow rates are unaffected by changes of capacity of intake fan 130 in response to the static pressure sensor 174**.

The volumetric flow rates of multiple fume hoods of a laboratory room and of the thermostat-controlled exhaust flow rate of that room are separately obtained from the various exhaust-regulating circuits. For example, a signal may be obtained almost anywhere in the circuit of FIG. 2 to represent the flow rate, inasmuch as the signal from the slide contact of transducer 46, and especially the signal from zero-and-span circuit 48-1, is proportional to the flow rate signal to E-to-P actuator 44a in FIG. 2. However, it is contemplated that device 54 of FIG. 5 may be introduced between zero-and-span circuit 48-1 and E-to-P actuator 44a in FIG. 2; and then the signal to E-to-P actuator could be used as a representation of the flow rate of the controlled exhaust damper. In this respect, the signal in FIG. 5 representing the sash position cannot be used as a representation of the flow rate because of the controlled non-linearity introduced by device 54 in FIG. 5. Instead, the signal to E-to-P regulator 44a can be used as a flow-rate representation. Accordingly, in developing a control signal for VAV box 166 in FIG. 11, signals representing the sash positions can be used as flow-representing signals where proportional control of flow rate is used. On the other hand, where controlled non-linearity is developed by the control circuit of the VAV box regulator, that controlled non-linear signal can serve as a representation of the volumetric flow rate of a fume hood.

Separately, as noted above, flow-rate sensors 148 and 152 (FIG. 11) of laboratory rooms may serve as a direct measurement of each of the flow rates.

Figure 11A:
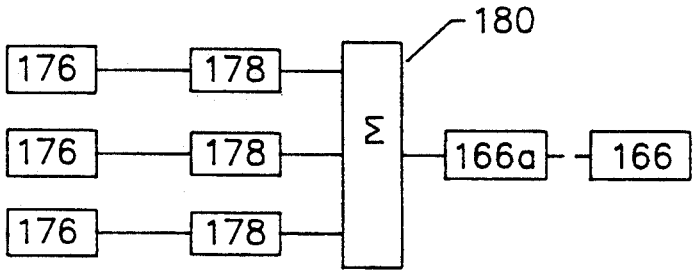
FIGS. 11A, 11B, and 11C are block diagrams of control circuits for the air flow system of FIG. 11.

FIG. 11A shows a flow-rate control circuit for a laboratory room's air supply VAV box 166. Flow-rate signal sources 176 represent any of the signal supply sources mentioned above. A flow rate signal to the E-to-P actuator of a room-exhaust VAV box or valve in any of FIGS. 2, 2A, 3-3A-3B, or 8 may serve as any one of the flow rate signal sources 176 in FIG. 11A. The flow-rate representing signals may be equal—even unrelated—for different fume hoods whose sizes may be widely different. Accordingly, scaling devices 178 convert the flow-rate signals of sources 176 to reflect the true proportions of the volumetric flow rates of the various fume hoods. The scaled signals are summed (or averaged) in summer 180 and used to control actuator 166a of VAV box 166. Controlled non-linearity of the fume hood exhaust flow rates (if present) is taken into account in this manner in regulating the volumetric flow rate of the air supplied to each laboratory room.

Figure 11B:
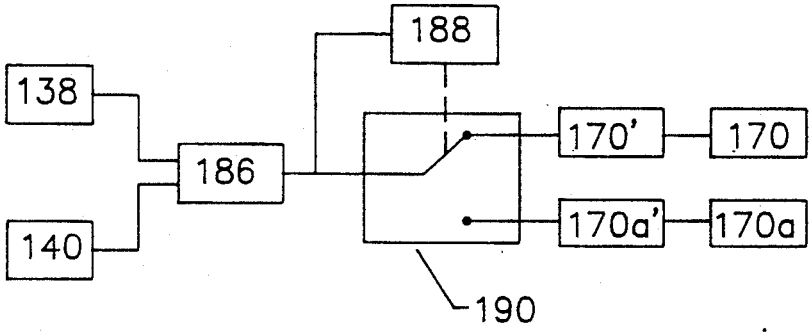

FIG. 11B diagrammatically shows the control circuit for VAV boxes 170 and 170a (FIG. 11). The volumetric flow-rate signal of supply flow-rate sensor 138 is compared to that of exhaust flow-rate sensor 140 of FIG. 11, and both the value and sign of the difference is derived by a difference-taking circuit 186. This may be a summer, one signal and the inverse of the other being added. The sign of the difference is sensed by device 188 to control switching device 190. For one polarity, the signal controls E-to-P actuator 170' of VAV box 170. For the opposite polarity, switching device 190 reverses so that the output signal of difference-taking circuit 186 controls E-to-P actuator 170a' of VAV box 170a. Manifestly, in systems where air must be supplied to the residual areas, devices 188, 190, 170a' and 170a may be omitted. That represents the most common situation (considered in detail above), where the laboratory rooms are negatively pressurized and where the flow rate of the discharge air from offices into the residual areas is less than that needed in negatively pressurizing the laboratory rooms.

Figure 11C:
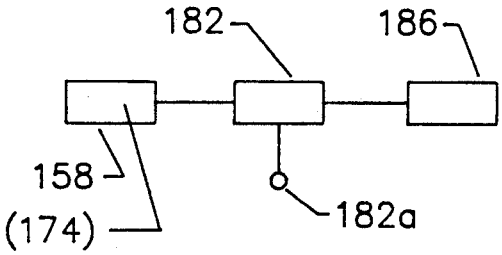

FIG. 11C diagrammatically represents the control of the intake fan as well as the control of the exhaust fan. Reference numerals in parentheses represent the intake fan and its control; the other numerals represent the exhaust fan and its control.

Static pressure sensor 158 in the exhaust duct provides an input signal to circuit 182 for comparison with a reference signal 182a. The output is a difference signal that is impressed on fan control circuit 186, for adjusting the capacity of fan 132 in the direction to adjust the static pressure at sensor 158 so as to reduce to zero the output of circuit 182. The end effect is to adjust the static pressure at sensor 158 at that standardized value that causes all of the exhaust-regulating air valves to operate consistently, in accordance with their adjustments. The circuit of FIG. 11C operates with like effect in adjusting the capacity of intake air handler 134 for consistent operation of the various VAV boxes and other air valves in the supply duct. Alternatively, the circuit 48' of FIG. 2A may replace circuit 182 of FIG. 11C. With this alternative, signal 182(a) would replace the set point signal 46-3 of FIG. 2A. The signal generated by sensor 158(174) would replace the signal of circuit 50 of FIG. 2A and would replace the E-to-P actuator 44a of FIG. 2A.

Any air valve regulates the rate of the air flowing through it consistently for any particular signal applied to its actuator so long as the pressure difference between its inlet and its discharge sides is maintained constant. This is true of VAV boxes 170 and 170a, even when (if) they are positioned closer to supply fan 130 than static pressure sensor 174 and might be subject to a greater static pressure difference than that which prevails at the static pressure sensor. It might be considered that the flow rate resulting from any particular control voltage applied to a valve actuator could vary in dependence on the pressure difference between its inlet and discharge sides. However such an effect may be avoided, if desired, in several ways with respect to all the VAV boxes of the illustrative apparatus. Some such valves are made static pressure independent over a range of adjustments and conditions by mechanical design, as by including a compensating spring or a static-pressure responsive adjustment. VAV boxes ar also rendered system static pressure independent by including a flow-rate sensor as part of a feedback loop in the valve-actuator control circuit, for example as shown in FIGS. 2A, 5 and 8. In particular, VAV boxes 170 and 170a are system static pressure independent for the reason that their flow rates are inherently regulated by flow sensors; each VAV box 170 or 170a has that signal level applied to its actuator that is needed to maintain balance (or a small imbalance, if desired) between the sensed supply and exhaust flow rates independent of the valve characteristics.

The illustrative embodiments of the invention in its various aspects, shown in the accompanying drawings and described in detail above, may be modified and rearranged in various ways and they may be applied in various ways by those skilled in the art. Consequently, the invention should be construed broadly, in accordance with its true spirit and scope.

What is claimed is:

1. Apparatus for controlling the flow of exhaust of a fume hood having an exhaust passage and having a sash that is adjustable for providing a variable sash opening into the hood, said apparatus including exhaust means for discharging exhaust from the fume hood and thereby drawing air into the fume hood through said sash opening, and control means for said exhaust means, said control means comprising means for causing the rate of exhaust flow to increase as the opening of the sash is increased through a first range up to roughly halfway open and to increase in a second range approaching full opening of the sash, said control means including regulating means for causing the increase of the exhaust flow rate versus increasing sash opening to be distinctively more rapid in said second range than in said first range of sash openings.

2. Apparatus as in claim 1, wherein control includes means for sensing the rate of flow of exhaust in said exhaust passage and for providing an exhaust flow rate signal.

3. Apparatus as in claim 1, wherein said control means includes sensing means for providing said control means with an exhaust flow rate signal that changes non-linearly so as to cause said distinctively more rapid increase of the exhaust flow rate.

4. Apparatus as in claim 2, wherein said exhaust flow rate signal is proportional to the exhaust flow rate, said regulating means including a circuit response to said flow-rate signal non-linearly for developing said distinctively more rapid increase of the exhaust flow rate for sash openings approaching said fully open sash position.

5. Apparatus as in claim 1, 2, 3, or 4, wherein said exhaust means includes an adjustable damper in said exhaust passage controlled by said control means.

6. Apparatus as in claim 1, wherein said control means includes a face velocity sensor comprising means forming a passage from the exterior of the fume hood to an opening inside the fume hood exposed to the flow of the air drawn into the fume hood and an air velocity sensor in said passage, said control means further including means responsive to said face velocity sensor for causing the rate of exhaust flow to increase as the opening of the sash is increased, and wherein said regulating means includes an exhaust flow rate sensor and means responsive to said exhaust flow rate sensor for causing said distinctively more rapid increase of the exhaust flow rate in said second range than in said first range of sash openings.

7. Apparatus as in claim 1, wherein said control means includes sash position sensing means for providing a sash opening signal.

8. Apparatus as in claim 7, wherein the sash comprises two sash panels adjustable relative to each other and to the fume hood for providing said variable sash opening, and wherein said sash position sensing means includes a sash position sensor for each of said sash panels and means responsive to both of said sash position sensors for providing said sash opening signal.

9. Apparatus as in claim 1, wherein said control means includes sash opening sensor means for providing a signal proportional to the sash opening and also includes exhaust flow rate sensing means for supplying an exhaust flow rate signal, said regulating means comprising means for causing the exhaust flow rate signal to change non-linearly versus sash opening.

10. Apparatus as in claim 1, wherein said control means includes sash position sensor means for providing a signal proportional to the sash opening and exhaust flow rate sensing means for providing an exhaust flow rate signal that varies linearly with the exhaust flow rate.

11. Apparatus as in claim 1, wherein said sash comprises a pair of vertically adjustable sash panels in said sash opening, the sash panels having a combined height and vertical ranges of adjustment for jointly obstructing all or any desired portion of said sash opening, said sash position signal means including sash height signal providing means for representing the heights of said sash panels and panel adjustment signal providing means for representing the vertically adjusted positions of said sash panels, and output signal means responsive to said sash-height signal providing means and to said sash adjustment signal providing means for developing a sash opening signal that represents that portion of said sash opening that is unobstructed by said sash panels.

12. Apparatus for controlling the flow of exhaust of a fume hood having an exhaust passage and having a sash that is adjustable for providing a variable sash opening into the hood, said apparatus including sash position signal means for providing a sash position signal that is a progressively variable representation of the sash opening, exhaust means for discharging exhaust from the fume hood and thereby drawing air into the fume hood through said sash opening, and control means for said exhaust means including said sash position signal means and means responsive thereto, for causing the rate of exhaust flow to increase as the opening of the sash is increased through a first range up to roughly halfway open and to increase in a second range approaching full opening of the sash, said control means including regulating means for causing the increase of the exhaust flow rate versus increasing sash opening to be distinctively more rapid in said second range than in said first range of sash openings.

13. Apparatus as in claim 1 or 12 wherein said control means causes the exhaust flow rate to vary essentially continuously for progressive increases of the sash openings in said first range of sash openings and continuing as the sash opening changes to said second range and approaches its fully open position.

14. Apparatus as in claim 12 wherein said control means includes flow-rate responsive means for providing a signal representing the exhaust flow rate, said flow-rate responsive means including a flow responsive transducer in said exhaust passage.

15. Apparatus as in claim 1, 12 or 14 wherein said exhaust means includes an adjustable damper in said exhaust passage, said adjustable damper being responsive to said control means.

16. Apparatus as in claim 1, 12 or 14 wherein said exhaust means includes an adjustable-capacity exhaust fan, and wherein said control means includes means for adjustably controlling the capacity of said exhaust fan.

17. Apparatus as in claim 14 wherein said regulating means is incorporated in said exhaust flow-rate responsive transducer.

18. Apparatus as in claim 14 wherein said control means includes two circuit channels, one of which is responsive to said sash position signal means and the other of which is responsive to said flow responsive transducer, and wherein one of said channels includes said regulating means for causing said distinctively more rapid increase of the exhaust flow rate.

19. Apparatus for controlling the flow of air in a building module having predominantly special procedure rooms that are to be maintained different by a negative offset pressure from residual areas of the building module adjoining said rooms and for maintaining the residual areas at neutral pressurization relative to the building's exterior, said residual areas being connected by constricted passages to said special procedure rooms, said apparatus including an exhaust fan for discharging exhaust from the building module and an exhaust duct system extending from said exhaust fan to said special procedure rooms, a supply fan for drawing air into the building module and a supply duct system extending from said supply fan to said special procedure rooms, exhaust damper means for regulating exhaust flows drawn from the special procedure rooms into the exhaust duct system at controlled exhaust volumetric flow rates, supply damper means for regulating supply flows of air from said supply duct system to said special procedure rooms at volumetric flow rates lower than said controlled exhaust volumetric flow rates of said rooms, respectively, for maintaining the special procedure rooms at negative offset pressured relative to said residual areas, residual area damper means for regulating a flow of supply air from said supply duct system to said residual areas for making up the difference between the exhaust flows and the supply flows of said rooms, and means for maintaining the volumetric flow rates of the exhaust duct system and of the supply duct system in balance, said maintaining means including means for sensing and comparing the volumetric flow rates of the supply and exhaust duct systems and means responsive to said comparing means for regulating said residual area damper means for maintaining said balance.

20. Apparatus as in claim 19 wherein said special procedure rooms are at least predominantly laboratory rooms having fume hoods each of which has its respective exhaust regulating damper means.

21. Apparatus as in claim 19 wherein said supply and exhaust duct systems contain respective static pressure sensors and wherein said supply and exhaust fans are responsive to their respective static flow sensors for maintaining an adequate pressure differential between inlet and discharge sides of all of said damper means.

22. Apparatus as in claim 19 wherein said special procedure rooms have room thermostat controlled exhaust damper means.

23. Apparatus as in claim 19 wherein the building module has general purpose rooms having room thermostat responsive supply damper means for regulating the supply of air from the supply duct system, said general purpose rooms being arranged to discharge their supply flows o air into said residual areas.

24. Apparatus as in claim 19 wherein said damper means for regulating the supply flow rate to said residual areas is static pressure independent.

25. Apparatus as in claim 19 wherein said supply damper means and said exhaust damper means are static pressure independent.

26. Apparatus for controlling the flow of air in a laboratory building module which has multiple laboratory rooms from which exhaust is to be discharged, each laboratory room having at least one fume hood in which exhaust develops, said laboratory module additionally having residual areas adjoining said laboratory rooms and having restricted air passages between said residual areas and said laboratory rooms, said apparatus including an exhaust fan for discharging exhaust from the laboratory building module and an exhaust duct system extending from said laboratory rooms to said exhaust fan, said exhaust duct system including a fume hood exhaust duct for each fume hood, a supply fan for drawing air into the laboratory building module and a supply duct system extending from said supply fan to said laboratory rooms, one of said duct systems extending to said residual areas, exhaust damper means for regulating the volumetric exhaust flow rate of each of the fume hoods of each laboratory room into the exhaust duct system, supply damper means for regulating the supply of air to each laboratory room from the supply duct system at a supply flow rate that differs by an offset flow rate from the total flow rate of exhaust from such laboratory room, air at said offset flow rate passing between such laboratory room and said residual areas via said restricted passages, thereby causing the air pressure in the laboratory rooms to be offset from the air pressure in said residual areas, means for measuring the entire volumetric flow rate of the exhaust discharged from the exhaust duct system by said exhaust fan, means for measuring the entire volumetric flow rate of air provided to the air supply duct system by the supply fan, and residual area damper means for regulating the flow of air between said residual areas and said one of said duct systems at such a flow rate as to maintain essential equality between the entire volumetric flow rate of the supply duct system and the entire volumetric flow rate of the exhaust duct system.

27. Apparatus as in claim 26 further including for each laboratory room, room-temperature controlled exhaust means arranged to discharge air from the laboratory room into said exhaust duct system.

28. Apparatus as in claim 26 wherein means is provided for sensing the flow rate of the exhaust from each fume hood, said means for regulating the supply of air to each laboratory room including means collectively responsive to all of said exhaust flow rate sensing means of said laboratory room.

29. Apparatus as in claim 26 further including, for each laboratory room, room-temperature controlled exhaust means arranged to discharge air from the laboratory room into said exhaust duct system, and wherein said means for regulating the laboratory room supply of air includes means for providing representations of the separate exhaust flow rates of each fume hood and of the room-temperature controlled exhaust means and means for combining those separate flow rates.

30. Apparatus as in claim 26 for controlling the flow of air in a laboratory building module having, in addition to said laboratory rooms, at least one non-laboratory room having room-temperature responsive means for providing a controlled supply of air from said supply duct system to such non-laboratory room, said non-laboratory room having air discharge passage means to said residual areas.

31. Apparatus as in claim 26 wherein said means for regulating the supply of air into at least one of said laboratory rooms is set for supplying less air than the aggregate exhaust from such laboratory rooms, for developing negative air pressure in said laboratory rooms.

32. Apparatus as in claim 26 wherein said means for regulating the supply of air into at least one of said laboratory rooms is set for supplying more air than the aggregate exhaust from such laboratory rooms, for developing positive air pressure in each such laboratory room.

33. Apparatus as in claim 26 wherein the aggregate exhaust flow rates of all the laboratory rooms exceeds the aggregate controlled supply flow rates to all of the rooms of the laboratory building module, said one of the duct systems to which the residual areas extend being the supply duct system.

34. Apparatus as in claim 26 wherein the aggregate exhaust flow rates of all the laboratory rooms is less than the aggregate controlled exhaust flow rates to all of the rooms of the laboratory building module, said one of the duct systems to which the residual areas extend being the exhaust duct system.

35. Apparatus as in claim 26 wherein fan capacity regulating means is provided for each of said supply fan and said exhaust fan and wherein pressure sensors are located in said supply duct system and in said exhaust duct system for controlling each of the regulating means of each of said fans so as to maintain at least the required minimum operating static pressure drop across each of said damper means.

36. Apparatus for controlling the flow of exhaust of a fume hood having an exhaust passage and having a sash that is adjustable for providing a variable sash opening into the hood, said apparatus including exhaust means for discharging exhaust from the fume hood and thereby drawing air into the fume hood through said sash opening, and control means for controlling the flow rate of the exhaust in said exhaust means, said control means including (a) face velocity sensing means for providing a face velocity signal, said face velocity sensing means having a first passage extending from outside a fume hood to a first opening inside the fume hood and having a first air velocity sensor in said passage, and (b) means responsive to said face velocity signal providing means for causing the rate of exhaust flow to increase as the opening of the sash is increased through a first range up to roughly halfway open and to increase in a second range approaching full opening of the sash, and (c) exhaust flow sensing means for providing an exhaust flow rate signal, said control means including regulating means responsive to said exhaust flow rate signal for causing the increase of the rate of exhaust flow versus increasing sash opening to be distinctively more rapid in said second range than in said first range of sash openings.

37. Apparatus as in claim 36 wherein said face velocity sensing means includes a second passage extending from the exterior of said fume hood to a second opening inside the fume hood and a second air velocity sensor in said second passage, said first and second openings being spaced apart substantially, and wherein said face velocity sensing means includes means responsive to both of the first and second air velocity sensors to provide said face velocity signal.

38. Apparatus as in claim 37 wherein said openings of said passages are at opposite sides of the fume hood.

39. Apparatus as in claim 37 wherein said openings of said passages are at opposite sides of the fume hood and at substantially different heights.

* * * * *